US010287756B2

(12) United States Patent
Kobayashi et al.

(10) Patent No.: US 10,287,756 B2
(45) Date of Patent: May 14, 2019

(54) TAP WATER MANAGEMENT SYSTEM, TAP WATER MANAGEMENT DEVICE, TAP WATER MANAGEMENT METHOD, AND TAP WATER MANAGEMENT PROGRAM RECORDING MEDIUM

(71) Applicant: NEC Corporation, Minato-ku, Tokyo (JP)

(72) Inventors: Dai Kobayashi, Tokyo (JP); Takahiro Kumura, Tokyo (JP); Masatake Takahashi, Tokyo (JP)

(73) Assignee: NEC CORPORATION, Tokyo (JP)

( * ) Notice: Subject to any disclaimer, the term of this patent is extended or adjusted under 35 U.S.C. 154(b) by 114 days.

(21) Appl. No.: 15/519,896

(22) PCT Filed: Oct. 20, 2015

(86) PCT No.: PCT/JP2015/005274
§ 371 (c)(1),
(2) Date: Apr. 18, 2017

(87) PCT Pub. No.: WO2016/067558
PCT Pub. Date: May 6, 2016

(65) Prior Publication Data

US 2017/0247863 A1 Aug. 31, 2017

(30) Foreign Application Priority Data

Oct. 29, 2014 (JP) ..... 2014-219807

(51) Int. Cl.

| | |
|---|---|
| ***E03B 1/02*** | (2006.01) |
| ***E03B 7/00*** | (2006.01) |
| ***E03B 7/07*** | (2006.01) |

(52) U.S. Cl.
CPC ..... *E03B 7/071* (2013.01); *E03B 1/02* (2013.01); *E03B 7/003* (2013.01); *E03B 7/075* (2013.01)

(58) Field of Classification Search
CPC . E03B 1/02; E03B 7/003; E03B 7/071; E03B 7/075
See application file for complete search history.

(56) References Cited

U.S. PATENT DOCUMENTS 5,460,196 A 10/1995 Yonnet
5,771,920 A * 6/1998 Jewett ..... E03B 7/071 137/460

(Continued)

FOREIGN PATENT DOCUMENTS

JP H01-251211 A 10/1989
JP H06-161565 A 6/1994

(Continued)

OTHER PUBLICATIONS

"Corrosion of facility's pipe laying and deterioration diagnosis", Suga technical report, No. 30394, Suga Co., Ltd.

(Continued)

*Primary Examiner* — William M McCalister

(57) ABSTRACT

In order to keep the deterioration of water distribution pipes from progressing, a tap water management system is provided with: a water pressure detection unit for detecting the water pressure in at least one location in a water distribution pipe for carrying clean water from a water distribution site to a consumer. and transmitting the detection result as water pressure information; a deterioration detection unit for detecting deterioration in at least one location in a water distribution pipe, and transmitting the detection result as deterioration information; a water distribution planning unit for causing a water distribution plan that is a plan for water distribution pressure to be determined on the basis of (Continued)

information regarding past water demand; a deterioration-reducing water distribution planning unit for deciding, on the basis of the water distribution plan, the water pressure information, and the deterioration information. a deterioration-reducing water distribution plan according to the extent of deterioration; a water distribution pressure changing unit for changing the water distribution pressure of the water distribution pipe; and a water distribution pressure control unit for controlling the water distribution pressure changing unit on the basis of the deterioration-reducing water distribution plan.

14 Claims, 14 Drawing Sheets

(56) References Cited

U.S. PATENT DOCUMENTS

| | | | | |
|---|---|---|---|---|
| 2008/0251131 | A1* | 10/2008 | Ford | E03B 7/071 137/39 |
| 2008/0266125 | A1* | 10/2008 | Windisch | E03B 7/071 340/605 |
| 2010/0313958 | A1* | 12/2010 | Patel | E03B 7/071 137/1 |
| 2013/0092242 | A1* | 4/2013 | Guy | E03B 7/071 137/2 |
| 2014/0149054 | A1* | 5/2014 | Hanss | E03B 7/003 702/35 |
| 2014/0332088 | A1* | 11/2014 | Senesh | E03B 1/02 137/14 |
| 2015/0114490 | A1* | 4/2015 | Carpenter | E03B 7/072 137/460 |
| 2015/0204701 | A1* | 7/2015 | Klicpera | G01M 3/00 137/624.11 |

FOREIGN PATENT DOCUMENTS

| | | | |
|---|---|---|---|
| JP | H07-163815 | A | 6/1995 |
| JP | H08-96039 | A | 4/1996 |
| JP | 2000-266219 | A | 9/2000 |
| JP | 2001-055763 | A | 2/2001 |
| JP | 2003-075212 | A | 3/2003 |
| JP | 2006-104777 | A | 4/2006 |
| JP | 2007-270562 | A | 10/2007 |
| JP | 2009-209523 | A | 9/2009 |
| JP | 2012-193585 | A | 10/2012 |
| JP | 2015-190825 | A | 11/2015 |
| WO | 2013/145493 | A1 | 10/2013 |

OTHER PUBLICATIONS

Spark Streaming Programming Guide, The Apache Software Foundation, Spark (TM) 2.1.0.

International Search Report for PCT Application No. PCT/JP2015/005274, dated Dec. 1, 2015.

English translation of Written opinion for PCT Application No. PCT/JP2015/005274.

* cited by examiner

TAP WATER MANAGEMENT SYSTEM, TAP WATER MANAGEMENT DEVICE, TAP WATER MANAGEMENT METHOD, AND TAP WATER MANAGEMENT PROGRAM RECORDING MEDIUM

This application is a National Stage Entry of PCT/JP2015/005274 filed on Oct. 20, 2015, which claims priority from Japanese Patent Application 2014-219807 filed on Oct. 29, 2014, the contents of all of which are incorporated herein by reference, in their entirety.

TECHNICAL FIELD

The present invention relates to a tap water management system for supplying clean water to a consumer through a water distribution pipe network, a tap water management device, a tap water management method, and a tap water management program recording medium.

BACKGROUND ART

In a tap water management system, clean water is supplied from a service reservoir to a consumer that is an end user through the water distribution pipe network. In this case, the tap water management system supplies clean water by increasing a water pressure (water distribution pressure) in a water distribution pipe by using a pump pressurization method in which water is pressurized by a pump or the like or a gravity pressurization method in which water is pressurized by using a height difference between the service reservoir located on a high place and a customer's premises. The tap water management system controls this water distribution pressure to maintain the water pressure at the customer's premises at a predetermined level.

As a first example of controlling the water distribution pressure, a control method in which the water distribution pressure is controlled according to a water distribution plan that is previously determined based on the supply and demand forecast or the like can be used. In patent literature 3, there is described a system in which a water distribution amount based on the water distribution plan is calculated by simulating the water distribution pipe network.

As a second example of controlling the water distribution pressure, a method in which an output of a water distribution control device located near the service reservoir is controlled by feedback control while monitoring the current water pressure in the water distribution pipe network or the water pressure at the customer's premises can be used. For example, in patent literature 2, there is described a technology for suppressing the control performance deterioration due to the secular change of the water distribution pipe network by using a model based on actual process data of an inflow amount, a discharge pressure, a water pressure at the customer's premises, and a demand. Further, in patent literature 1, there is described a water distribution pressure control device to which a modeling error is taken into consideration.

On the other hand, a metal such as a stainless steel, a carbon steel, or the like or a resin such as vinyl chloride or the like is used for the water distribution pipe of which the water distribution pipe network is composed. It is known that by secular change (aged deterioration), a water delivery performance is decreased or a failure such as water leakage, water distribution pipe burst, or the like occurs. In non-patent literature 1, it is described that this deterioration is caused by corrosion on the inner surface of the water distribution pipe, scale deposition, reduction of a pipe diameter or blockage of a pipe caused by slime attachment, a pipe wall thickness loss due to corrosion, or corrosion on the external surface of the pipe when the pipe is buried in the ground.

Further, a technology for diagnosing and analyzing a degree of deterioration of the water distribution pipe is known. For example, in patent literature 4, there is described a technology for diagnosing a state of deterioration of a pipeline network by comparing event data of a pipeline measured by a vibration sensor or a flow rate sensor with a graph showing the aged deterioration characteristic. Further, in patent literature 5, there is described a technology for determining an opening and closing state of an opening and closing device based on opening-closing information detected by an opening and closing sensor and analyzing a state of a pipe laying based on vibration information detected by the vibration sensor.

On the other hand, with the development of IT (Information Technology), a technology to instantly deal with a large amount of sensor information at a hub side is available at present. For example, in non-patent literature 2, there is described a technology for dealing with stream data such as sensor data in several seconds and comparing it with the stored data.

CITATION LIST

Patent Literature

[PTL 1] Japanese Patent Application Laid-Open No. 2012-193585 (FIG. 1)

[PTL 2] Japanese Patent Application Laid-Open No. 2009-209523 (FIG. 1)

[PTL 3] Japanese Patent Application Laid-Open No. 2006-104777 (FIG. 1)

[PTL 4] Japanese Patent Application 2012-083205

[PTL 5] Japanese Patent Application No. 2014-067605

Non Patent Literature

[NPL 1] "Corrosion of facility's pipe laying and deterioration diagnosis", Suga technical report, NO. 30394, SUGA Co., LTD.

[NPL 2]
https://spark.apache.org/docs/latest/streaming-programming-guide.html

SUMMARY OF INVENTION

Technical Problem

In the technology described in patent literature 3, merely, the water distribution amount based on the water distribution plan is calculated by simulating the water distribution pipe network. Further, in the method for controlling the water distribution pressure described in patent literature 1 and patent literature 2, merely, the water distribution pressure is controlled based on the situation of the water pressure at the customer's premises. Accordingly, in the invention described in patent literature 1 to patent literature 3, a state in which the deterioration of the water distribution pipe actually progresses is not reflected. Therefore, a problem in which when a high water pressure or a greatly fluctuating water pressure is applied to the relatively deteriorated water distribution pipe, the deterioration progresses rapidly or a failure is triggered may occur. The deterioration of the water distribution pipe causes increase in water supply operation cost because an electric power for operating a water delivery pump increases. Further, the failure of the water distribution pipe may causes not only the increase in water supply operation cost caused by the increase in non-revenue water due to water leakage but also a big accident caused by the burst of the water distribution pipe. Further, rust inside the water distribution pipe or the dirt from the crack causes the deterioration of water quality.

On the other hand, by using the technology described in non-patent literature 1, non-patent literature 2, patent literature 4, or patent literature 5, the deteriorated section of the water distribution pipe may be determined early. However, even when these technologies are used, the progress of the deterioration of the water distribution pipe cannot be suppressed like the technologies described in patent literatures 1 to 3.

An object of the present invention is to solve the above-mentioned problem and provide a tap water management system which can suppress the progress of deterioration of a water distribution pipe, a tap water management device, a tap water management method, and a tap water management program.

Solution to Problem

A tap water management system according to an exemplary aspect of the present invention comprises: a water distribution pipe network including a water distribution pipe for carrying clean water from a water distribution site to a consumer; water pressure detection means for detecting a water pressure in at least one location in the water distribution pipe and transmitting a detection result as water pressure information; deterioration detection means for detecting deterioration of the water distribution pipe in at least one location and transmitting a detection result as deterioration information; water distribution plan means for determining a water distribution plan that is a plan of a water distribution pressure based on past information of water demand; deterioration-reducing water distribution plan means for determining a deterioration-reducing water distribution plan according to a degree of deterioration based on the water distribution plan, the water pressure information, and the deterioration information; water distribution pressure change means for changing the water distribution pressure in the water distribution pipe; and water distribution pressure control means for controlling the water distribution pressure change means based on the deterioration-reducing water distribution plan.

A tap water management system according to another exemplary aspect of the present invention comprises: a water distribution pipe network including a water distribution pipe for carrying clean water from a service reservoir to a consumer; a water pressure measurement terminal; a pipe vibration measurement terminal; and a water distribution plan calculator, wherein the water pressure measurement terminal at least include water pressure detection means for detecting the water pressure in at least one location in the water distribution pipe and transmitting a detection result as water pressure information, water pressure transition information storage means for storing the water pressure transition information transmitted from the water distribution plan calculator, and water pressure divergence detection means for comparing the water pressure information with the water pressure transition information, detecting divergence between a current water pressure and a planned water pressure, and outputting a detection result as water pressure divergence detection information, the pipe vibration measurement terminal includes deterioration detection means for detecting deterioration of the water distribution pipe in at least one location and transmitting a detection result as deterioration information and the water distribution plan calculator includes water distribution plan means for determining a water distribution plan that is a plan of a water distribution pressure based on past information of water demand, deterioration-reducing water distribution plan means for determining a deterioration-reducing water distribution plan according to a degree of deterioration based on the water distribution plan, the water pressure information, and the deterioration information, water distribution pressure change means for changing the water distribution pressure in the water distribution pipe, and water distribution pressure control means for controlling the water distribution pressure change means based on the deterioration-reducing water distribution plan.

A tap water management device according to still another aspect of the present invention is a tap water management device which controls a water distribution pressure in a water distribution pipe for carrying clean water from a service reservoir to a consumer, and the tap water management device comprises: water distribution plan means for determining a water distribution plan that is a plan of a water distribution pressure based on past information of water demand; deterioration-reducing water distribution plan means for determining a deterioration-reducing water distribution plan according to a degree of deterioration based on the water distribution plan, water pressure information of the water distribution pipe, and deterioration information of the water distribution pipe; and water distribution pressure control means for controlling the water distribution pressure based on the deterioration-reducing water distribution plan.

A tap water management method according to still another aspect of the present invention is a tap water management method for controlling a water distribution pressure in a water distribution pipe for carrying clean water from a service reservoir to a consumer, and the tap water management method comprises: determining a water distribution plan that is a plan of the delivery water pressure based on past information of water demand; determining a deterioration-reducing water distribution plan according to a degree of deterioration based on the water distribution plan, water pressure information of the water distribution pipe, and deterioration information of the water distribution pipe; and controlling the water distribution pressure based on the deterioration-reducing water distribution plan.

A tap water management program storage medium according to still another aspect of the present invention is a computer-readable non-transitory storage medium storing a program which causes a computer of a tap water management device which controls a water distribution pressure in a water distribution pipe for carrying clean water from a service reservoir to a consumer to perform; a water distribution plan function to determine a water distribution plan that is a plan of the water distribution pressure based on past information of water demand; a deterioration-reducing water distribution plan function to determine a deterioration-reducing water distribution plan according to a degree of deterioration based on the water distribution plan, water pressure information of the water distribution pipe, and deterioration information of the water distribution pipe; and a water distribution pressure control function to control the water distribution pressure based on the deterioration-reducing water distribution plan.

Advantageous Effect of Invention

By using the above-mentioned embodiment of the present invention, the progress of the deterioration of the water distribution pipe can be suppressed.

BRIEF DESCRIPTION OF DRAWINGS

FIG. 5 is a figure for explaining a deterioration-reducing method in which by reducing a valve opening-closing speed of a valve for opening and closing a water distribution pipe, a water pressure fluctuation is reduced.

FIG. 6 is a figure for explaining a deterioration-reducing method in which a water distribution amount distributed from each of a plurality of service reservoirs is controlled by opening and closing a valve.

DESCRIPTION OF EMBODIMENTS

<First Exemplary Embodiment>

(Explanation of Configuration)

Figure 1:
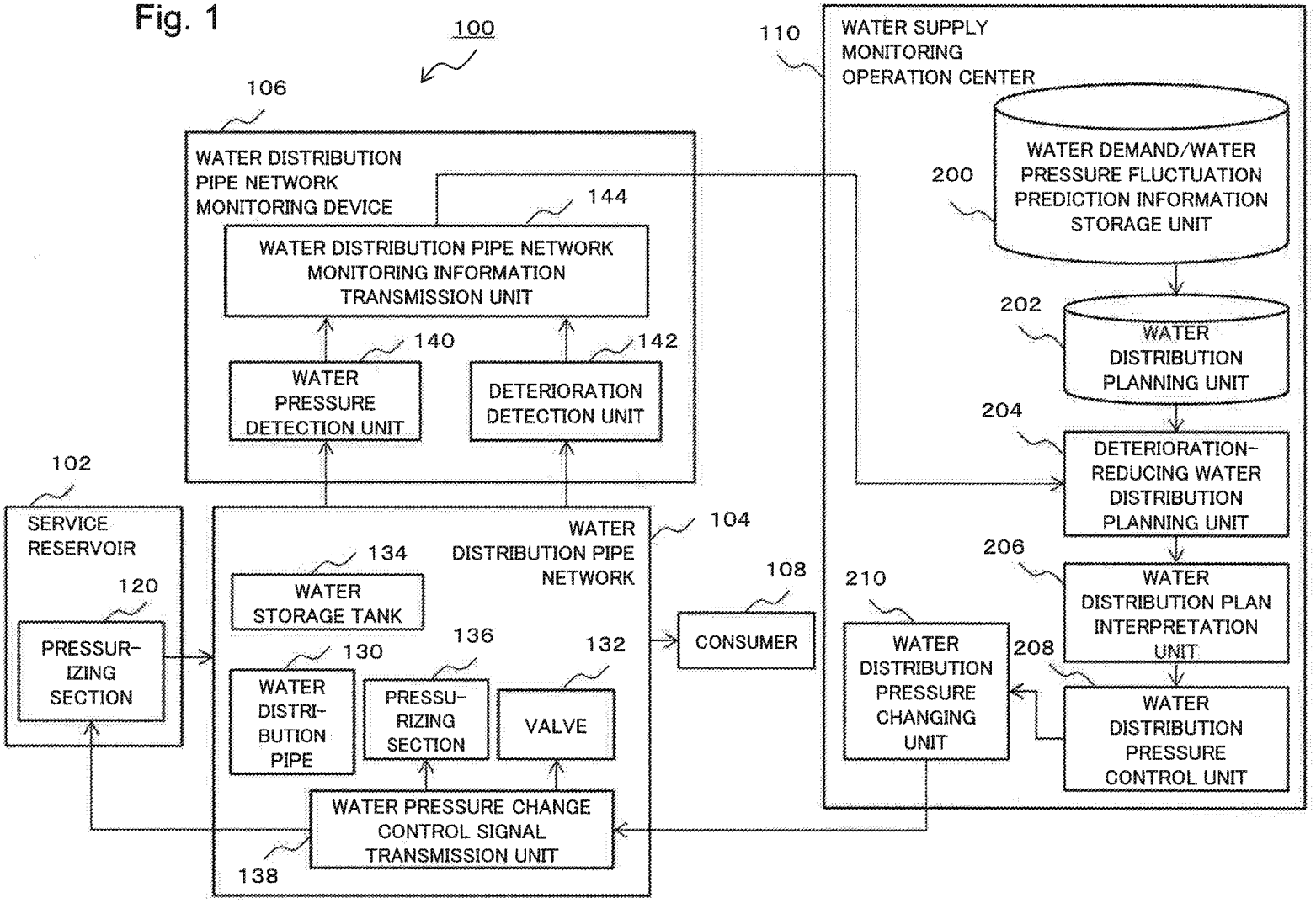
FIG. 1 is a block diagram showing an example of a configuration of a tap water management system according to a first exemplary embodiment of the present invention.

FIG. 1 is a block diagram showing an example of a configuration of a tap water management system 100 according to a first exemplary embodiment of the present invention. Further, in FIG. 1, a direction of an arrow is shown as an example. The direction of the signal flow between blocks is not limited to the direction shown in FIG. 1. This applies to another figure.

The tap water management system 100 includes a service reservoir 102, a water distribution pipe network 104, a water distribution pipe network monitoring device 106, a consumer 108, and a water supply monitoring operation center 110.

The service reservoir 102 is a plant in which the clean water obtained in a water purifying plant (not shown in FIG. 1) is pressurized and the pressurized clean water is delivered to the water distribution pipe network 104. Further, the service reservoir 102 may have not only a function to deliver the water but also a function to store water.

Further, the service reservoir 102 includes a pressurizing section 120. The pressurizing section 120 pressurizes the clean water and sends the pressurized clean water to the water distribution pipe network 104. A pressurization method used in the pressurizing section 120 can be arbitrarily determined. For example, a pump pressurization method in which water is pressurized by a pump or the like or a gravity pressurization method in which water is pressurized by using a height difference between the service reservoir 102 located on a high place and the pressurizing section 120 located at a lower elevation than the service reservoir 102 can be used.

The water distribution pipe network 104 is a facility for sending the clean water delivered from the service reservoir 102 to a consumer 108. The water distribution pipe network 104 includes a water distribution pipe 130, a valve 132, a water storage tank 134, a pressurizing section 136, and a water pressure change control signal transmission unit 138.

The water distribution pipe 130 is a pipe made of metal or resin and used as a water supply line. A plurality of water distribution pipes 130 are connected to each other by a joint to form the water distribution pipe network 104. The clean water is supplied to many consumers 108 through this water distribution pipe network 104. Further, the water distribution pipe 130 may be buried in the ground or laid on the ground in an exposed state.

The valve 132 is disposed between a plurality of the water distribution pipes 130 and adjusts an amount of the water by adjusting the pipe diameter. As the valve 132, a manual operation valve which is manually opened and closed or an electromagnetic valve which is electrically and automatically opened and closed by an electronic open-close signal is used. By opening and closing the valve, a surrounding water distribution pressure can be changed. Further, the valve 132 may include a pressure adjustment valve.

The water storage tank 134 has a function to store the clean water temporarily.

The pressurizing section 136 receives the clean water flowing in the water distribution pipe 130, pressurizes the clean water again, and delivers it like the pressurizing section 120 of the service reservoir 102. An arbitrary pressurization method can be used in the pressurizing section 136. For example, like the pressurizing section 120, a pump pressurization method in which water is pressurized by using a pump or the like or a gravity pressurization method in which water is pressurized by using a height difference between the water storage tank 134 located on a high place and the pressurizing section 136 located at a lower elevation than the water storage tank 134 can be used.

The water pressure change control signal transmission unit 138 transmits an instruction from a water distribution pressure changing unit 210 of which the water supply monitoring operation center 110 is composed to the pressurizing section 136 and/or the valve 132. The pressurizing section 136 adjusts the water pressure of the clean water flowing in the water distribution pipe 130 based on the instruction. The valve 132 adjusts an amount of the clean water flowing in the water distribution pipe 130 based on the instruction.

The consumer 108 is connected to the water distribution pipe 130. For example, the consumer 108 is a facility such as an ordinary home, a company, or the like which consumes the clean water. When the consumer 108 consumes the clean water, the water pressure at the connection point at which the water distribution pipe 130 is connecting to the consumer 108 and the water pressure in a surrounding area decrease.

The water distribution pipe network monitoring device 106 includes a water pressure detection unit 140, a deterioration detection unit 142, and a water distribution pipe network monitoring information transmission unit 144.

The water pressure detection unit 140 is means for converting the water pressure in the water distribution pipe 130 into electronic water pressure information. The water pressure detection unit 140 may be composed of a water pressure sensor which directly detects the water pressure in the water distribution pipe 130 or a device which converts a value measured by a water pressure gauge disposed on the water distribution pipe 130 into electronic data by an image processing or the like. This configuration is shown as an example. Therefore, the configuration of the water pressure detection unit 140 is not limited to the configuration described above.

The water distribution pipe network monitoring information transmission unit 144 transmits water pressure information and deterioration information to the water supply monitoring operation center 110. The water distribution pipe network monitoring information transmission unit 144 may be composed of for example, a GPRS (General Packet Radio Service) modem and a GSM (the registered trademark) line or a wire-line network such as a telephone line or the like. Further, where, GSM is an abbreviation of Global System for Mobile Communications. This configuration is shown as an example. Therefore, the configuration of the water distribution pipe network monitoring information transmission unit 144 is not limited to the above-mentioned configuration. Further, the water distribution pipe network monitoring information transmission unit 144 may transmit device state information indicating whether or not the device is operated.

The deterioration detection unit 142 detects deterioration of the water distribution pipe 130. The deterioration detection unit 142 will be described in detail below.

Figure 2:
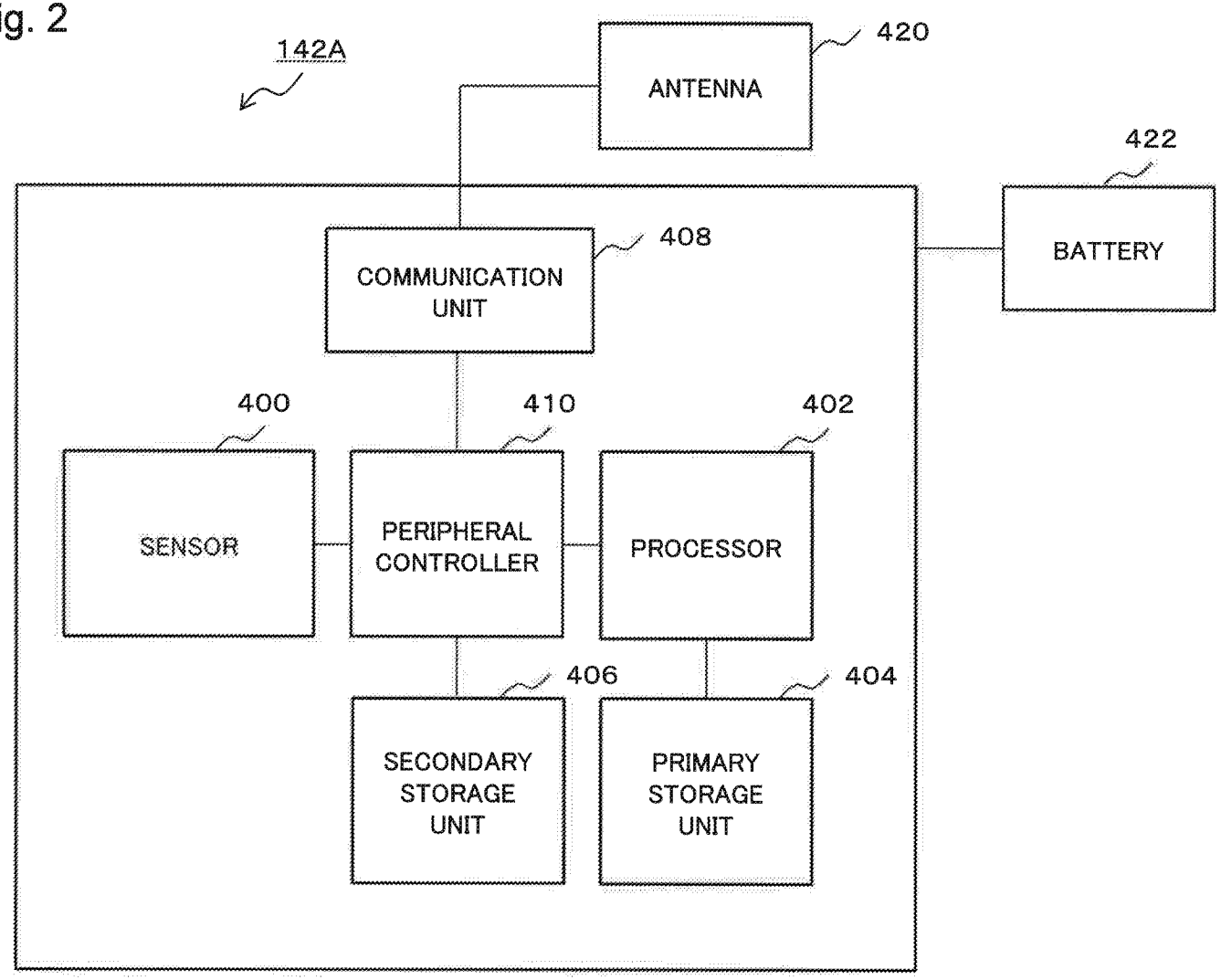
FIG. 2 is a block diagram showing an example of a first configuration of a deterioration detection unit shown in FIG. 1.

FIG. 2 is a block diagram of a deterioration detection unit 142A shown as a first configuration example of the deterioration detection unit 142 shown in FIG. 1. The deterioration detection unit 142A includes a sensor 400, a processor 402, a primary storage unit 404, a secondary storage unit 406, a communication unit 408, and a peripheral controller 410.

The sensor 400 converts the measured physical quantity into an electrical signal and outputs it as sensor data. The processor 402 processes the sensor data inputted from the sensor 400 as appropriate, stores the processed sensor data in the secondary storage unit 406, and transmits the sensor data to the water supply monitoring operation center 110 via the communication unit 408. The primary storage unit 404 stores the program and the data required for the operation of the processor 402. The peripheral controller 410 arbitrates the data transmission-reception among the sensor 400, the processor 402, the secondary storage unit 406, and the communication unit 408.

Further, the primary storage unit 404 is for example, a DRAM (Dynamic Random Access Memory) or a SRAM (Static Random Access Memory). The secondary storage unit 406 may be a detachable portable device such as a flash memory, a hard disk drive, or a SD (Secure Digital) card. By using a high-speed non-volatile memory such as a MRAM (Magnetoresistive Random Access Memory) or a ReRAM (Resistive Random Access Memory) as the medium, the primary storage unit 404 and the secondary storage unit 406 are mounted on the same device.

Further, in FIG. 2, one sensor 400 is shown as an example. However, a plurality of the sensors 400 may be used. An analog sensor or a digital sensor can be used as the sensor 400. Further, when the analog sensor is used for the sensor 400, an analog/digital converter is usually disposed between the sensor 400 and the peripheral controller 410.

As shown in FIG. 2, the deterioration detection unit 142A may further include an antenna 420 for communication and a battery 422 for operation.

The sensor 400 includes one or more sensors, such as a vibration sensor, a temperature sensor, a humidity sensor, a water quality sensor, an infrared sensor, and an ultrasonic sensor, detects a change in physical quantity that reflects the deterioration of the water distribution pipe 130, and converts it into electronic data.

For example, when the vibration sensor is used for the sensor 400, the processor 402 can analyze a change in feature for each vibration frequency, a change in resonance frequency, and a change in attenuation curve and thereby, quantify the change in physical quantity that reflects the deterioration of the water distribution pipe 130 such as scale deposition, slime attachment, crack or water leakage, a thickness loss, or the like.

Further, for example, when an acoustic vibration sensor and a temperature sensor are used for the sensor 400, the processor 402 can analyze a change in sound velocity and thereby, quantify the change in physical quantity that reflects the deterioration of the water distribution pipe 130.

Further, for example, when an infrared sensor is used for the sensor 400, the processor 402 can quantify a physical phenomenon such as occurrence of rust and crack on the surface of the water distribution pipe buried in the ground and a change in vibration of the pipe that reflects the deterioration of the water distribution pipe 130.

Further, for example, when an ultrasonic sensor is used for the sensor 400, the processor 402 can quantify a size and a depth of the crack that does not appear on the surface.

Further, for example, when a water quality sensor is used for the sensor 400, the processor 402 can quantify the deterioration of the water distribution pipe 130 by detecting rust or slime which exists in water inside the water distribution pipe 130 or soil or microorganism which enters the water distribution pipe 130 through a crack.

Further, when a plurality of sensors which measure the same physical quantity are used or when a plurality of sensors which measure different physical quantities are used, the deterioration of the water distribution pipe 130 can be quantified with a higher degree of accuracy.

Figure 3:
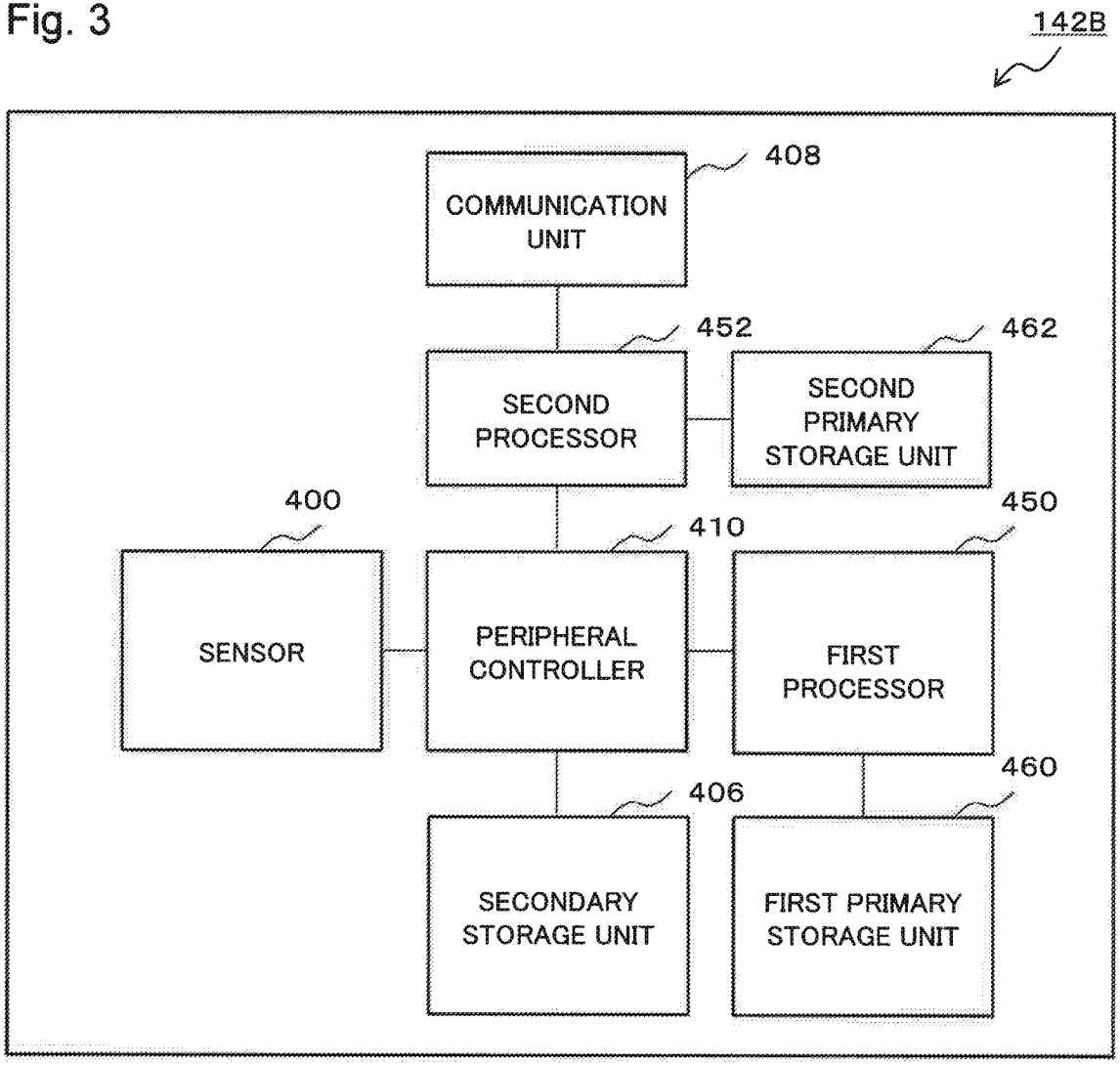
FIG. 3 is a block diagram showing an example of a second configuration of a deterioration detection unit shown in FIG. 1.

FIG. 3 is a block diagram of a deterioration detection unit 142B shown as a second configuration example of the deterioration detection unit 142 shown in FIG. 1. The deterioration detection unit 142B is characterized by including a plurality of processors. Specifically, as shown in FIG. 3, the deterioration detection unit 142B includes a first processor 450 for storing data and a second processor 452 for performing a deterioration detection process and processing the data. In this case, a first primary storage unit 460 used for only the first processor 450 is disposed. Further, a second primary storage unit 462 used for only the second processor 452 is disposed.

Further, the deterioration detection unit 142 shown in FIG. 1 is not necessarily disposed in the water distribution pipe network monitoring device 106.

Figure 4:
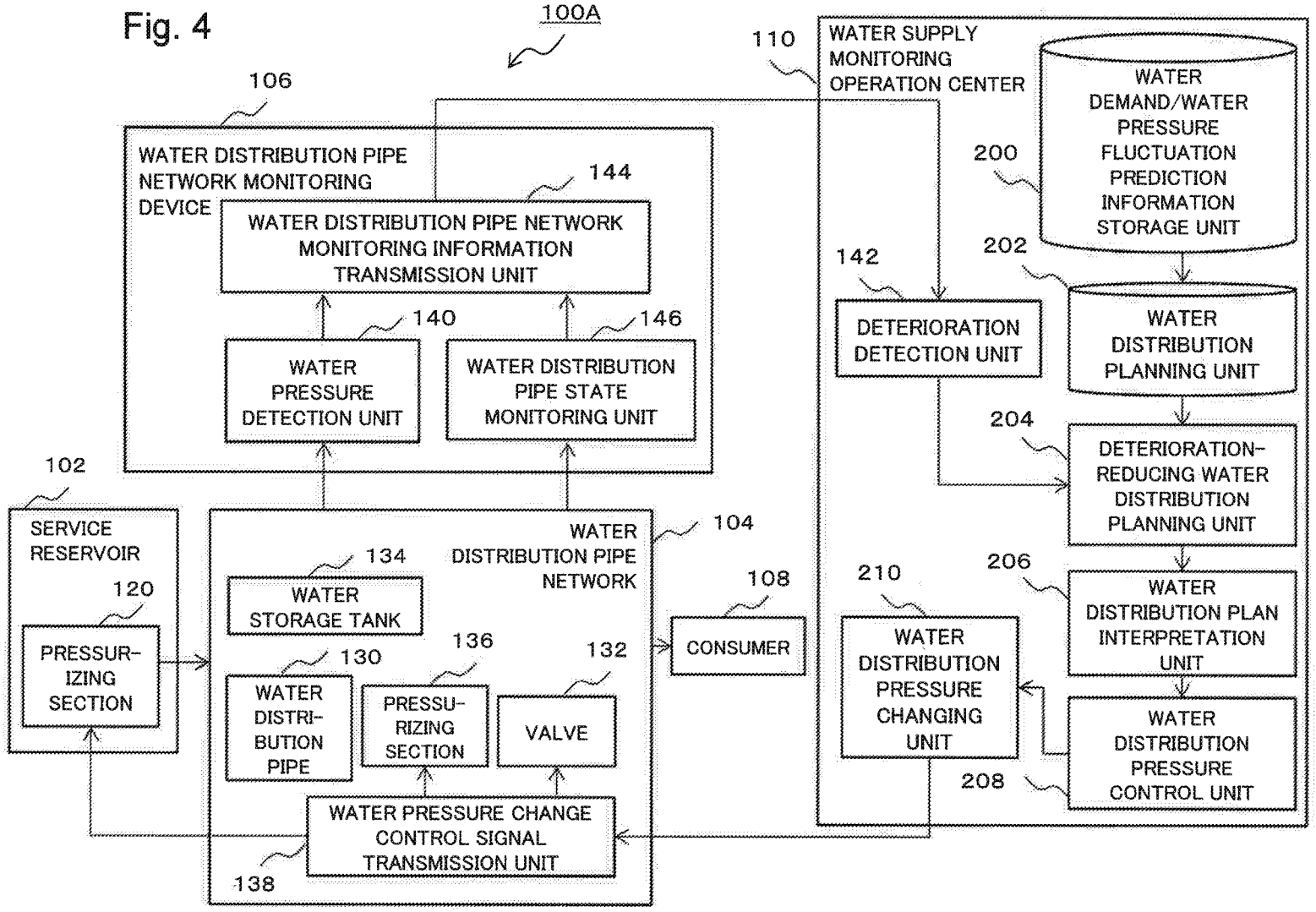
FIG. 4 is a block diagram showing an example of a configuration of a tap water management system as a modification example of a tap water management system shown in FIG. 1.

FIG. 4 is a block diagram showing an example of a configuration of a tap water management system 100A shown as a modification example of the tap water management system 100 shown in FIG. 1. As shown in FIG. 4, the deterioration detection unit 142 is disposed in the water supply monitoring operation center 110. In this case, the water distribution pipe network monitoring device 106 includes a water distribution pipe state monitoring unit 146. The water distribution pipe state monitoring unit 146 is a sensor disposed on the water distribution pipe 130. The water distribution pipe state monitoring unit 146 transmits the sensor data that is not processed to the water distribution pipe network monitoring information transmission unit 144. Finally, the sensor data is transmitted to the deterioration detection unit 142 disposed in the water supply monitoring operation center 110. The deterioration detection unit 142 detects the deterioration of the water distribution pipe 130 based on the received sensor data.

Here, explanation will be continued with reference to FIG. 1. The water supply monitoring operation center 110 includes a water demand/water pressure fluctuation prediction information storage unit 200, a water distribution planning unit 202, a deterioration-reducing water distribution planning unit 204, a water distribution plan interpretation unit 206, a water distribution pressure control unit 208, and the water distribution pressure changing unit 210.

The water demand/water pressure fluctuation prediction information storage unit 200 stores water demand/water pressure fluctuation prediction information that is information used for determining a plan for the water distribution pressure. The water demand/water pressure fluctuation prediction information is information about for example, a water demand pattern for each day of the week, the current day of the week, a water demand pattern for each weather, a current and future weather, an event such as e fireworks event, a soccer game, or the like in which a popular program is broadcasted and there is a high possibility that the water demand greatly fluctuates, water consumption characteristics for each area, and the like. These information are shown as an example. The water demand/water pressure change forecast information is not limited to the above-mentioned information.

The water distribution planning unit 202 determines the water distribution plan that shows the water distribution pressure for each time in the current day and the next day based on at least the water demand/water pressure fluctuation prediction information.

The deterioration-reducing water distribution planning unit 204 determines the deterioration-reducing water distribution plan based on the water distribution plan, the water pressure information of the water distribution pipe 130, and the deterioration information. A method for determining the deterioration-reducing water distribution plan will be described later.

The water distribution plan interpretation unit 206 outputs the deterioration-reducing water distribution plan inputted from the deterioration-reducing water distribution planning unit 204 to the water distribution pressure control unit 208. For example, the water distribution plan interpretation unit 206 outputs the deterioration-reducing water distribution plan that is electronic data to the water distribution pressure control unit 208 via a network or interprocess communication. Alternatively, the water distribution plan interpretation unit 206 displays or prints the deterioration-reducing water distribution plan for visualization. A worker of the center recognizes the visualized information and inputs the deterioration-reducing water distribution plan to the water distribution pressure control unit 208 which operates on a computer by using an input device such as a keyboard, a switch, or the like.

The water distribution pressure control unit 208 controls the valve 132 and the pressurizing section 136 via the water distribution pressure changing unit 210 based on the deterioration-reducing water distribution plan. For example, the water distribution pressure control unit 208 can control the water distribution pressure by using the technology described in patent literature 1, patent literature 2, or patent literature 3. Further, the water distribution pressure control unit 208 can control the water distribution pressure by using another control method such as a feedback control method using a current water pressure at the customer's premises or a model predictive control method. Further, the above-mentioned control method is shown as an example. Therefore, the method for controlling the water distribution pressure used in the water distribution pressure control unit 208 is not limited to the above-mentioned method.

Here, the deterioration-reducing water distribution plan will be explained below by using four cases. Basically, explanation will be performed by using FIG. 1. However, another drawing may be used for the explanation in some cases.

Figure 5:
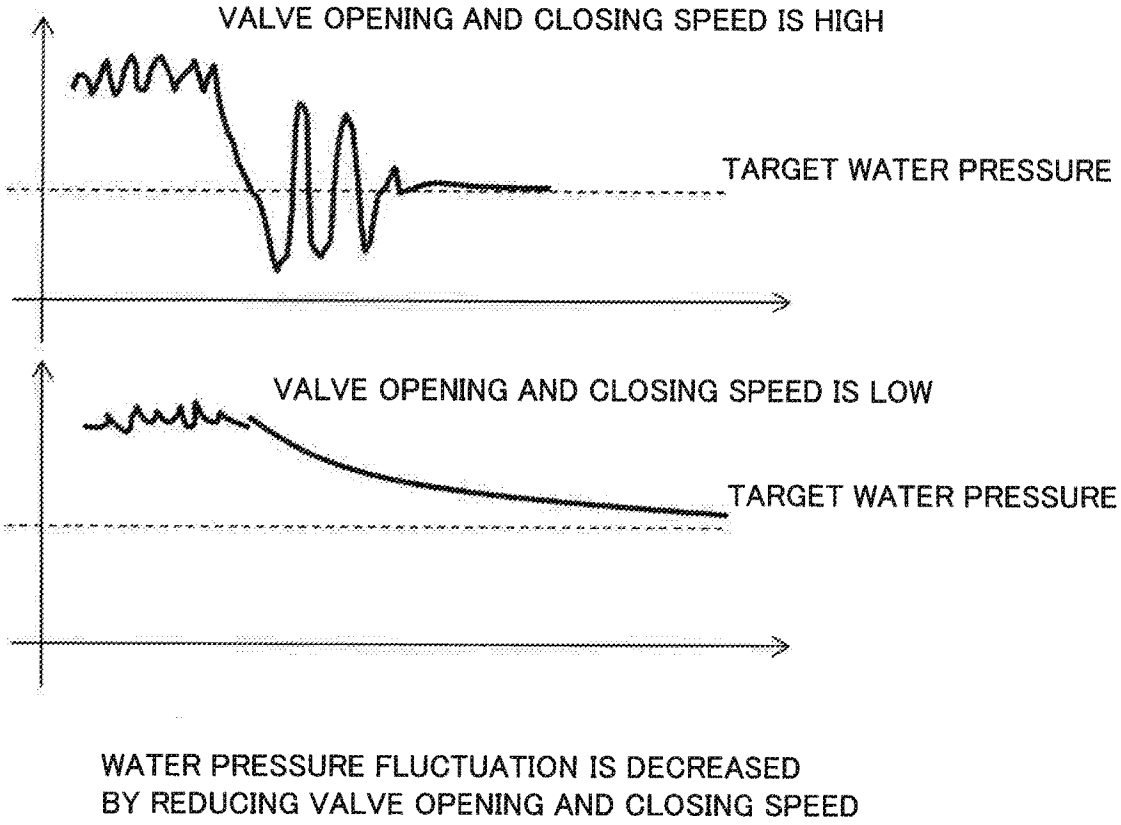
FIG. 5 is a figure for explaining a first deterioration-reducing method according to a first exemplary embodiment and in particular.

As a first case, for example, a case in which the deterioration-reducing water distribution plan is a plan to suppress a rapid water pressure fluctuation will be described. It is known that the rapid up and down fluctuation of the water pressure that is called a water hammer results in the deterioration or the breakdown of the water distribution pipe 130. When in the water distribution planning unit 202, a plan to open and close the valve 132 exists and the deterioration degree of the neighboring water distribution pipe 130 that is affected by the water pressure fluctuation generated by opening and closing the valve meets predetermined deterioration determination criteria, the deterioration-reducing water distribution planning unit 204 determines the deterioration-reducing water distribution plan by which the opening-closing speed of the valve 132 is reduced in order to further suppress the progress of the deterioration. For example, as shown in FIG. 5, by reducing the opening-closing speed of the valve 132, the water hammer generated by the rapid change of the water pressure can be suppressed.

Figure 6:
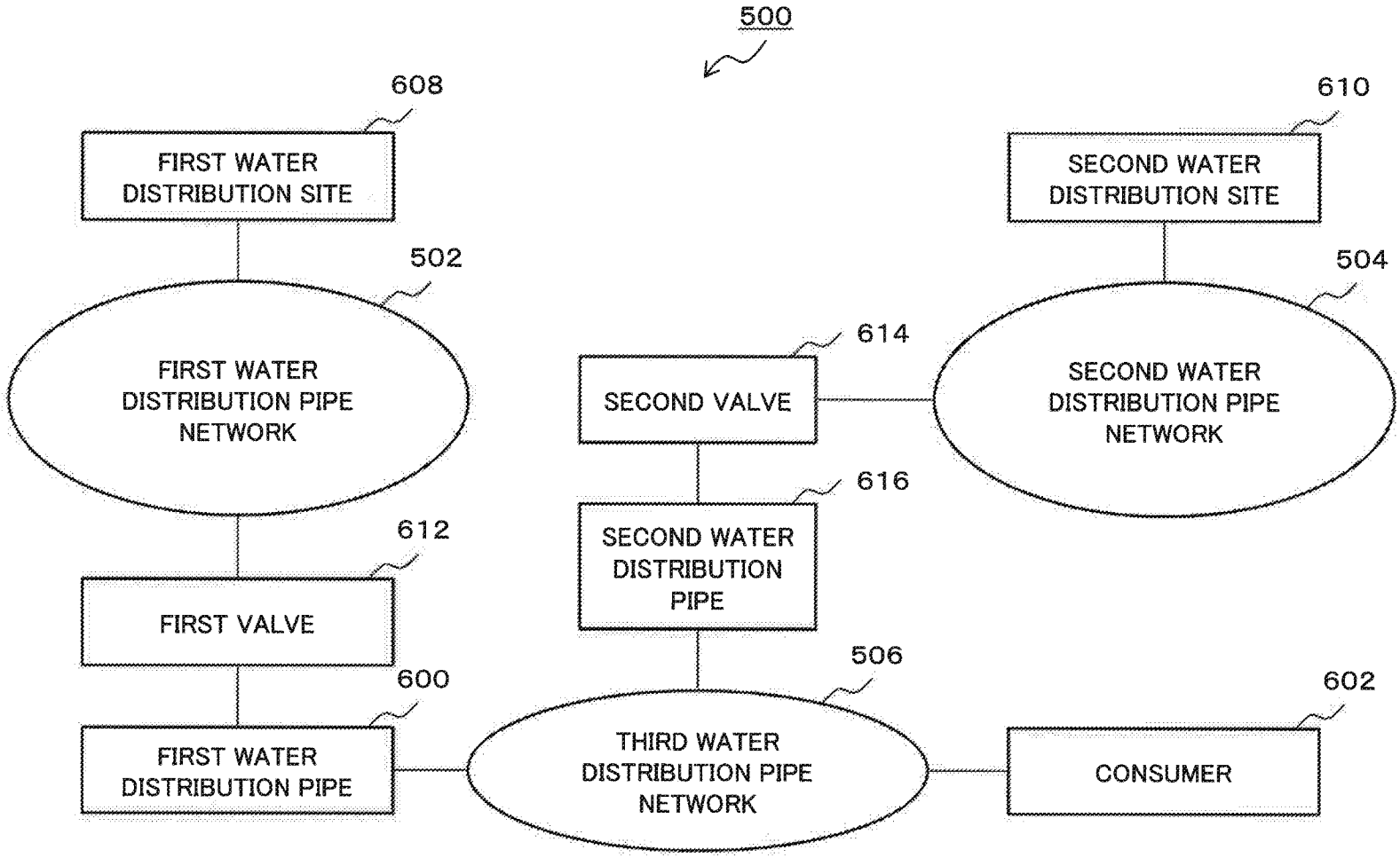
FIG. 6 is a figure for explaining a second deterioration-reducing method according to a first exemplary embodiment and in particular.

As a second case, for example, a case in which the deterioration-reducing water distribution plan is a plan to change a route of the water distribution pipe 130 will be described. As shown in FIG. 6, a predetermined water distribution pipe network 500 includes a first water distribution pipe network 502, a second water distribution pipe network 504, and a third water distribution pipe network 506. When the deterioration degree of a first water distribution pipe 600 of which the third water distribution pipe network 506 is composed meets the predetermined deterioration determination criteria, the deterioration-reducing water distribution planning unit 204 determines the deterioration-reducing water distribution plan by which a degree of opening of a first valve 612 is reduced so that the water distributed to a consumer 602 connected to the third water distribution pipe network 506 is mainly supplied from a second service reservoir 610 instead of a first service reservoir 608 and a degree of opening of a second valve 614 is increased. By performing the water distribution control based on the determined deterioration-reducing water distribution plan, the water pressure in the first water distribution pipe 600 decreases and the water pressure in a second water distribution pipe 616 increases. As a result, the progress of the deterioration of the first water distribution pipe 600 can be suppressed.

As a third case, for example, a case in which the deterioration-reducing water distribution plan is a plan to reduce the water distribution pressure will be described. When the consumer 108 uses tap water, the water distribution pressure decreases. Accordingly, an operation in which a high setting value with margin is used as the setting value of the water distribution pressure so that the predetermined water pressure can be maintained at the customer's premises even when tap water is used suddenly is used. When it is determined that the deterioration of the predetermined water distribution pipe 130 is serious, the deterioration-reducing water distribution planning unit 204 determines a deterioration-reducing water distribution plan to reduce the margin and perform the operation in which the low water distribution pressure is used. By this plan, the progress of the deterioration of the water distribution pipe can be suppressed.

As a fourth case, for example, a case in which the deterioration-reducing water distribution plan is a plan to exchange the water distribution pipe 130 with new one early will be described. When the deterioration degree of the water distribution pipe 130 meets the predetermined deterioration determination criteria, the deterioration-reducing water distribution planning unit 204 determines the deterioration-reducing water distribution plan to control the valve 132 and the pressurizing section 136 in order not to use this water distribution pipe 130 and also transmit a report to promote the exchange of the water distribution pipe 130 to the worker for maintaining the water distribution pipe network 104. By this plan, an enormous damage caused by the breakdown of the water distribution pipe 130 whose deterioration is progressed and the decrease of the degree of customer satisfaction can be suppressed and an idle worker can be efficiently used for a repair work.

Further, as the deterioration determination condition used in the above-mentioned four cases, a method in which a comparison with a predetermined specific absolute value is used, a method in which seriousness of the deterioration is determined by using information of a database of measured deterioration degree that is established in advance, a method in which the relative deterioration degree in the water distribution pipe network 104 is calculated and it is determined that the highly ranked one is a deteriorated pipe, or the like can be used.

The above-mentioned cases 1 to 4 are shown as an examples. Therefore, the deterioration-reducing water distribution plan is not limited to the plan shown in the above-mentioned cases.

Further, in the first exemplary embodiment described above, it has been explained that the deterioration-reducing water distribution planning unit 204 and the water distribution planning unit 202 are separated from each other. However, both units can be integrated as one unit. For example, it is possible to directly determine the deterioration-reducing water distribution plan by simultaneously performing a calculation by one algorithm or program without determining the water distribution plan.

(Explanation of Operation)

Figure 7:
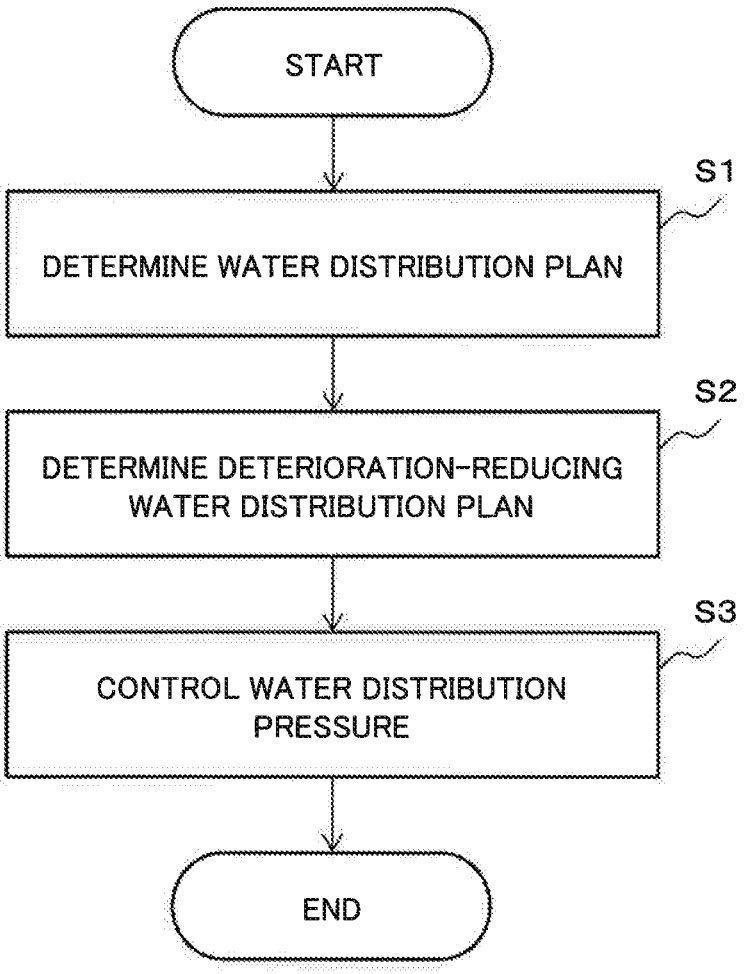
FIG. 7 is a flowchart for explaining an example of operation of a tap water management system shown in FIG. 1.

FIG. 7 is a flowchart for explaining an example of the operation of the tap water management system 100 shown in FIG. 1. The water distribution planning unit 202 determines the water distribution plan that is the plan of the water distribution pressure based on past information of water demand (step S1). The deterioration-reducing water distribution planning unit 204 determines the deterioration-reducing water distribution plan according to the deterioration degree based on the water distribution plan, the water pressure information, and the deterioration information (step S2). The water distribution pressure control unit 208 controls the water distribution pressure based on the deterioration-reducing water distribution plan (step S3).

(Explanation of Effect)

In the first exemplary embodiment described above, the water pressure in the water distribution pipe is controlled based on the deterioration-reducing water distribution plan in which the deterioration information of the water distribution pipe is reflected. Therefore, a case in which the deteriorated water distribution pipe is used in a high water pressure state or a state in which the water pressure greatly fluctuates is reduced. As a result, the first exemplary embodiment has an effect in which the progress of the deterioration of the water distribution pipe can be suppressed.

(Explanation of Modification Example)

Figure 8:
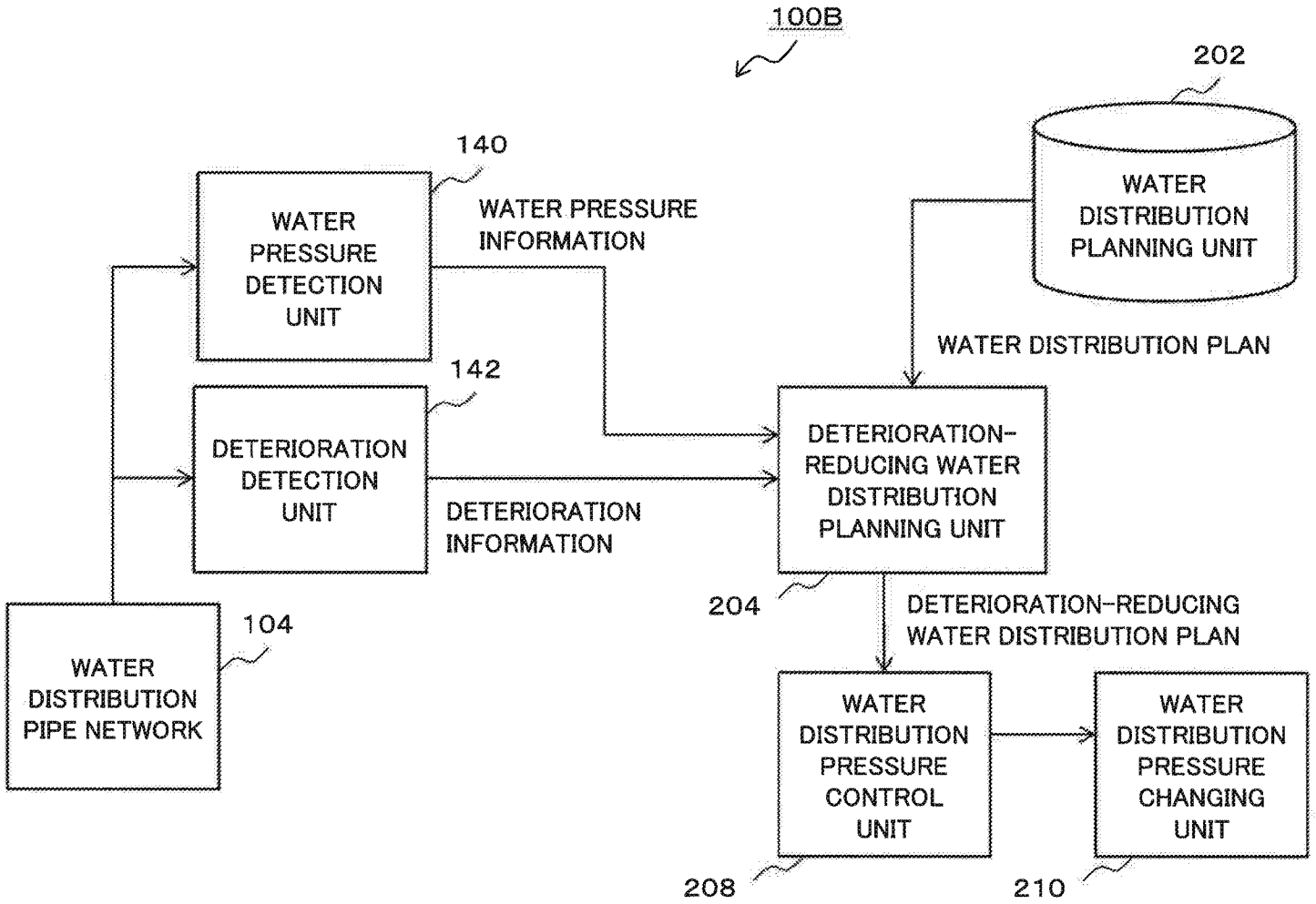
FIG. 8 is a block diagram showing an example of a configuration of a tap water management system as a first modification example of a first exemplary embodiment.

FIG. 8 is a block diagram showing an example of a configuration of a tap water management system 100B as a first modification example of the first exemplary embodiment. The tap water management system 100B includes only the component essential to this exemplary embodiment among all the components included in the tap water management system 100 shown in FIG. 1. These components are the same as those of the tap water management system 100. Therefore, the explanation of these components will be omitted. The tap water management system 100B has an effect similar to that of the first exemplary embodiment mentioned above.

Figure 9:
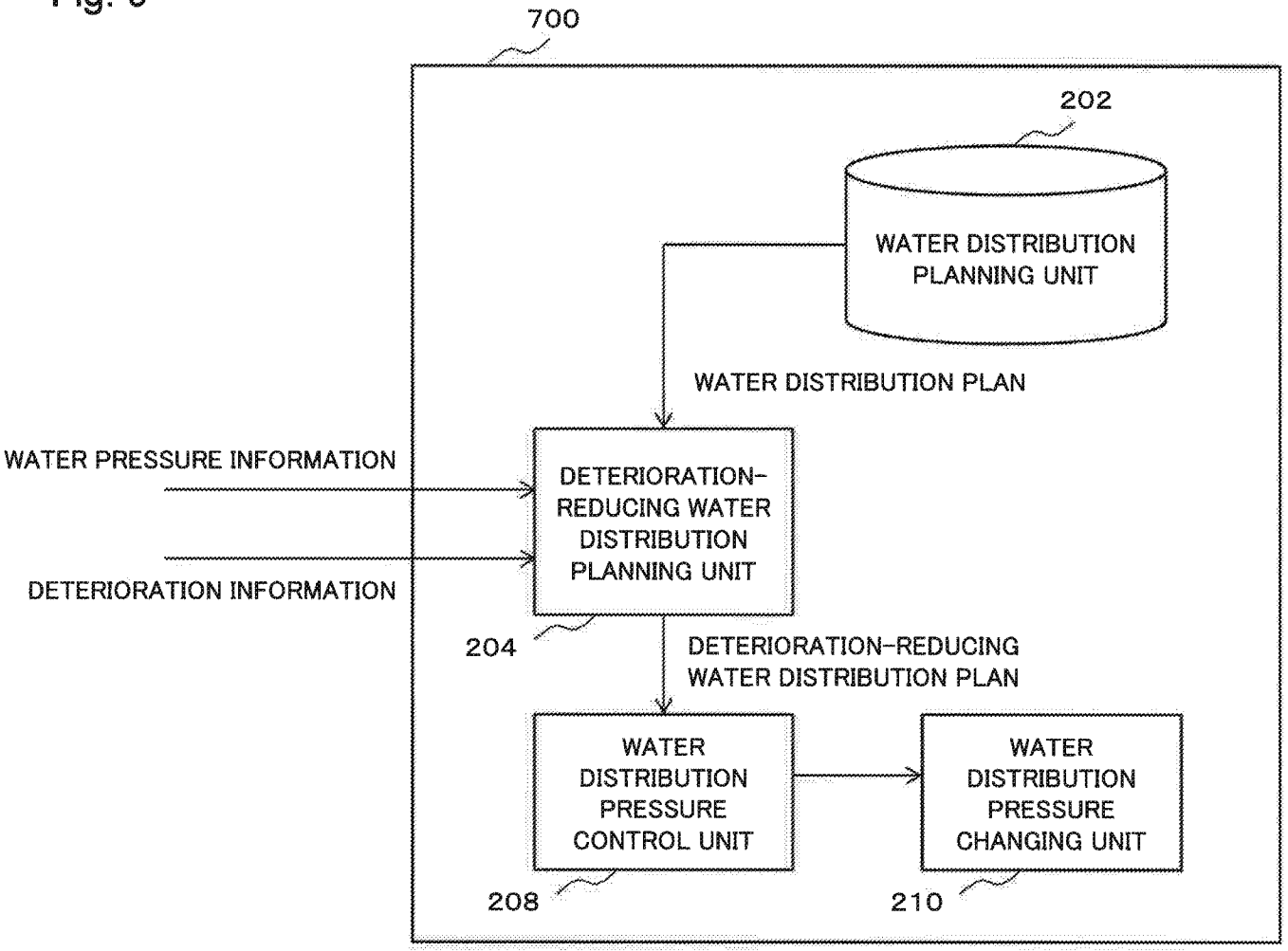
FIG. 9 is a block diagram showing an example of a configuration of a tap water management device as a second modification example of a first exemplary embodiment.

FIG. 9 is a block diagram showing an example of a configuration of a tap water management device 700 as a second modification example of the first exemplary embodiment. The tap water management device 700 includes the water distribution planning unit 202, the deterioration-reducing water distribution planning unit 204, the water distribution pressure control unit 208, and the water distribution pressure changing unit 210. Here, the tap water management device 700 does not include the water pressure detection unit 140 and the deterioration detection unit 142 shown in FIG. 1 and FIG. 8. In this case, the deterioration-reducing water distribution planning unit 204 acquires various information (water pressure information and deterioration information) from the water pressure detection unit 140 and the deterioration detection unit 142 disposed outside the device. The tap water management device 700 has an effect similar to that of the first exemplary embodiment.

<Second Exemplary Embodiment>

Figure 10:
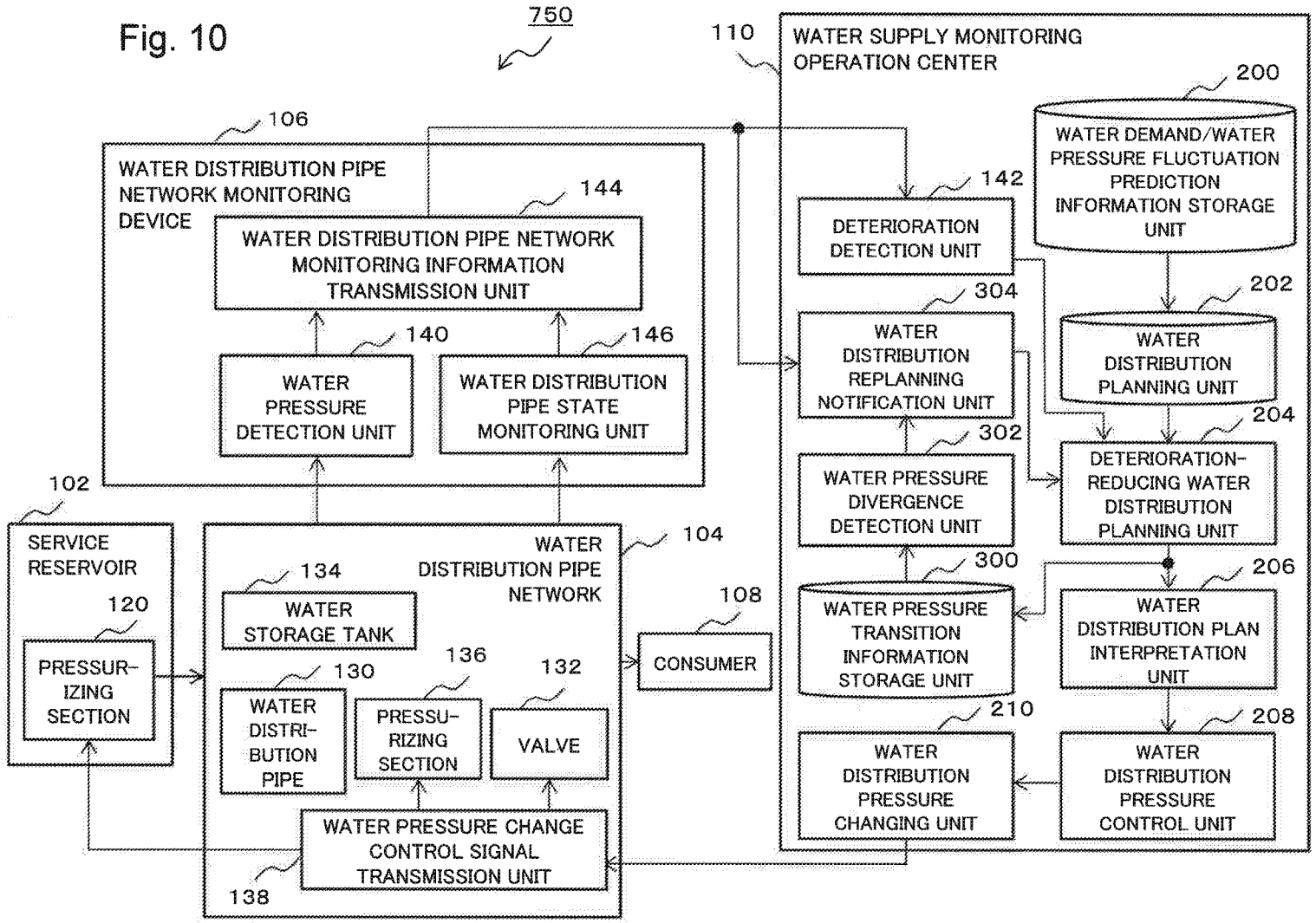
FIG. 10 is a block diagram showing an example of a configuration of a tap water management system according to a second exemplary embodiment of the present invention.

FIG. 10 is a block diagram showing an example of a configuration of a tap water management system 750 according to a second exemplary embodiment of the present invention. Further, the tap water management system 750 further includes a water pressure transition information storage unit 300, a water pressure divergence detection unit 302, and a water distribution re-planning notification unit 304 in addition to the components according to the first exemplary embodiment.

The water pressure transition information storage unit 300 stores an estimation value of the water pressure transition at a predetermined position in the water distribution pipe network 104 based on the deterioration-reducing water distribution plan.

As described later, when the water pressure divergence detection unit 302 detects divergence between the current water pressure and the above-mentioned estimation value, the water pressure divergence detection unit 302 instructs the deterioration-reducing water distribution planning unit 204 to recreate a water distribution plan via the water distribution re-planning notification unit 304.

Figure 11:
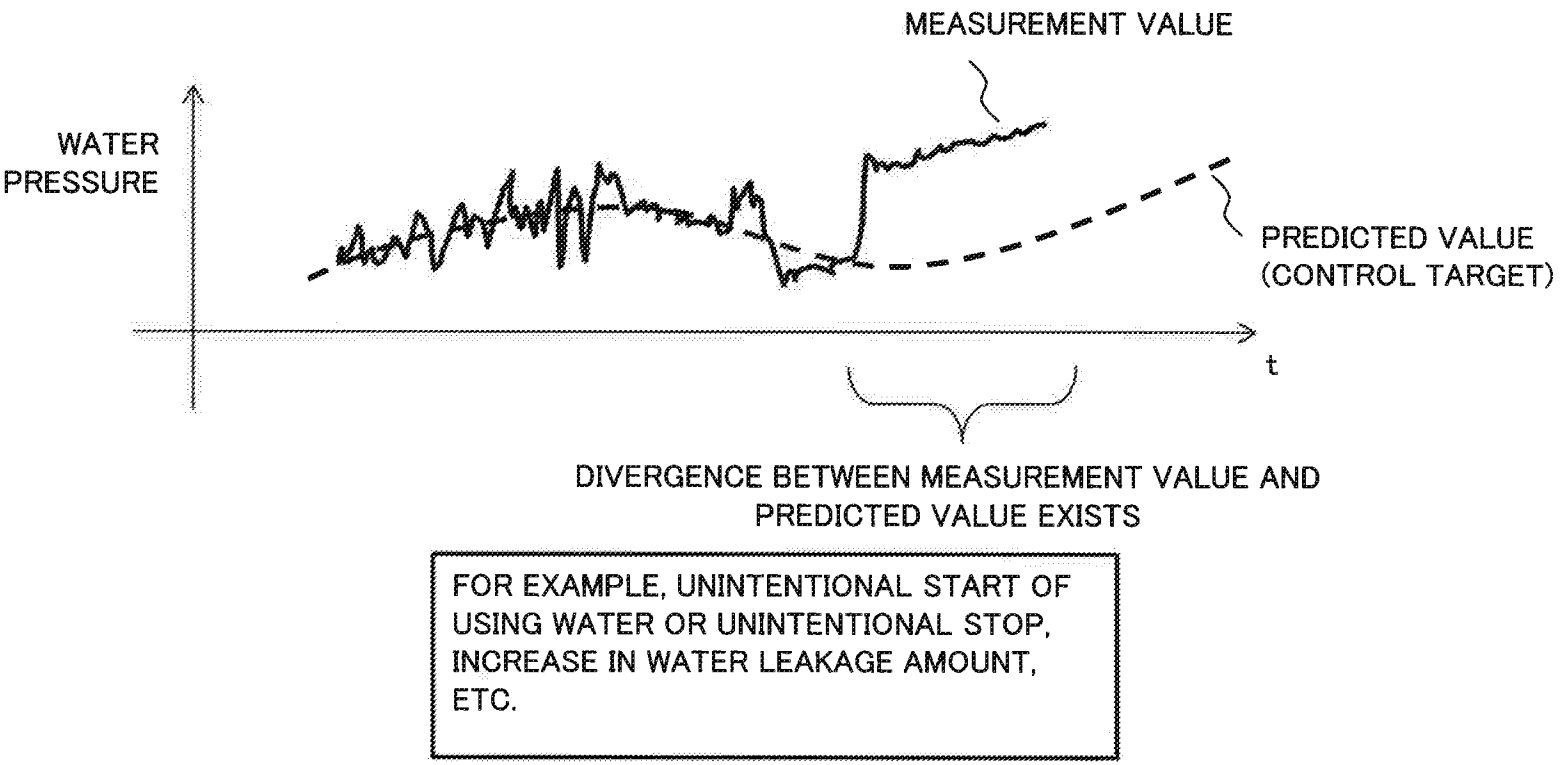
FIG. 11 is a conceptual diagram showing an example of a water pressure divergence detection in a water pressure divergence detection unit shown in FIG. 10.

FIG. 11 is a conceptual diagram showing an example of a water pressure divergence detection in the water pressure divergence detection unit 302 shown in FIG. 10. The divergence between the predicted value (control target) and the measurement value occurs at the time of an unintentional start of using water or an unintentional stop, an increase in water leakage amount, a theft of water, breakdown of a pump or a pipe, a failure of a water pressure measurement device, occurrence of physical noise, occurrence of electric noise, or the like.

Accordingly, for example, when the difference between the predicted value and the measurement value continuously exceeds a predetermined threshold value, the water pressure divergence detection unit 302 determines that divergence between the water pressures occurs.

Further, for example, when the difference between the predicted value and the measurement value continuously exceeds a predetermined value for at least a predetermined time period, the water pressure divergence detection unit 302 may determine that the divergence between the water pressures occurs.

Further, for example, when the difference between the predicted value and the measurement value that is calculated by using a predetermined mathematical model of the water pressure fluctuation does not match up with the difference between them that is calculated by using a statistical model, the water pressure divergence detection unit 302 may determine that the divergence between the water pressures occurs As described above, the tap water management system 750 according to the second exemplary embodiment has advantages in which a problem that a pipe is damaged when the sudden water pressure change occurs by the unintentional start of using water, the burst of the pipe, or the like can be solved in addition to the advantage of the first exemplary embodiment. This is because the water pressure divergence detection unit 302 can quickly detect the divergence between the current water pressure and the planned water pressure and the water distribution plan can be revised according to a current state of the water distribution pipe network.

Figure 12:
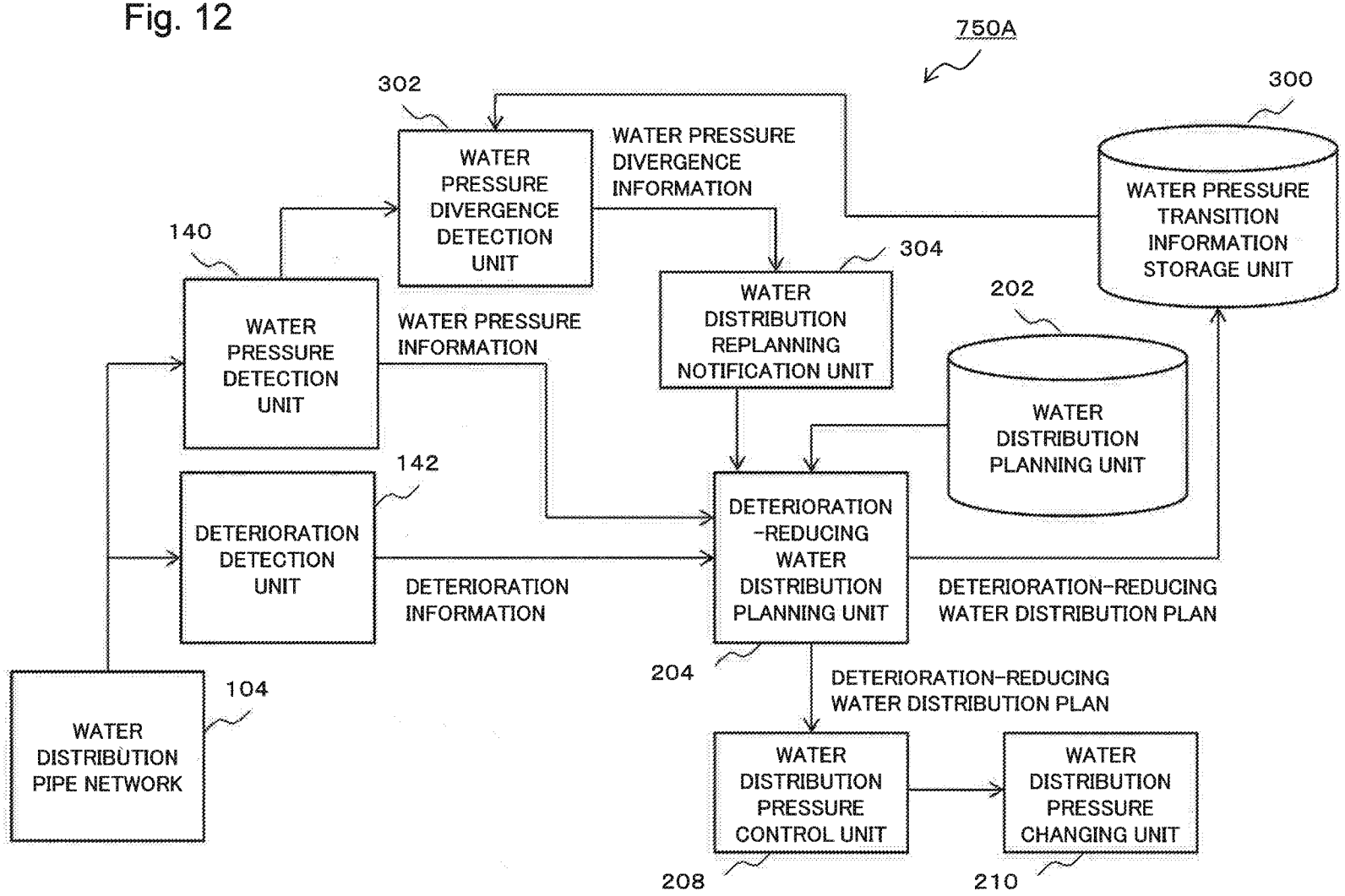
FIG. 12 is a block diagram showing an example of a configuration of a tap water management system as a modification example of a second exemplary embodiment.

FIG. 12 is a block diagram showing an example of a configuration of a tap water management system 750A as a modification example of the second exemplary embodiment. The tap water management system 750A includes only the component essential to this exemplary embodiment among all the components included in the tap water management system 750 shown in FIG. 10. These components are the same as those of the tap water management system 750. Therefore, the explanation of these components will be omitted. The tap water management system 750A has an effect similar to that of the second exemplary embodiment mentioned above.

<Third Exemplary Embodiment>

Figure 13:
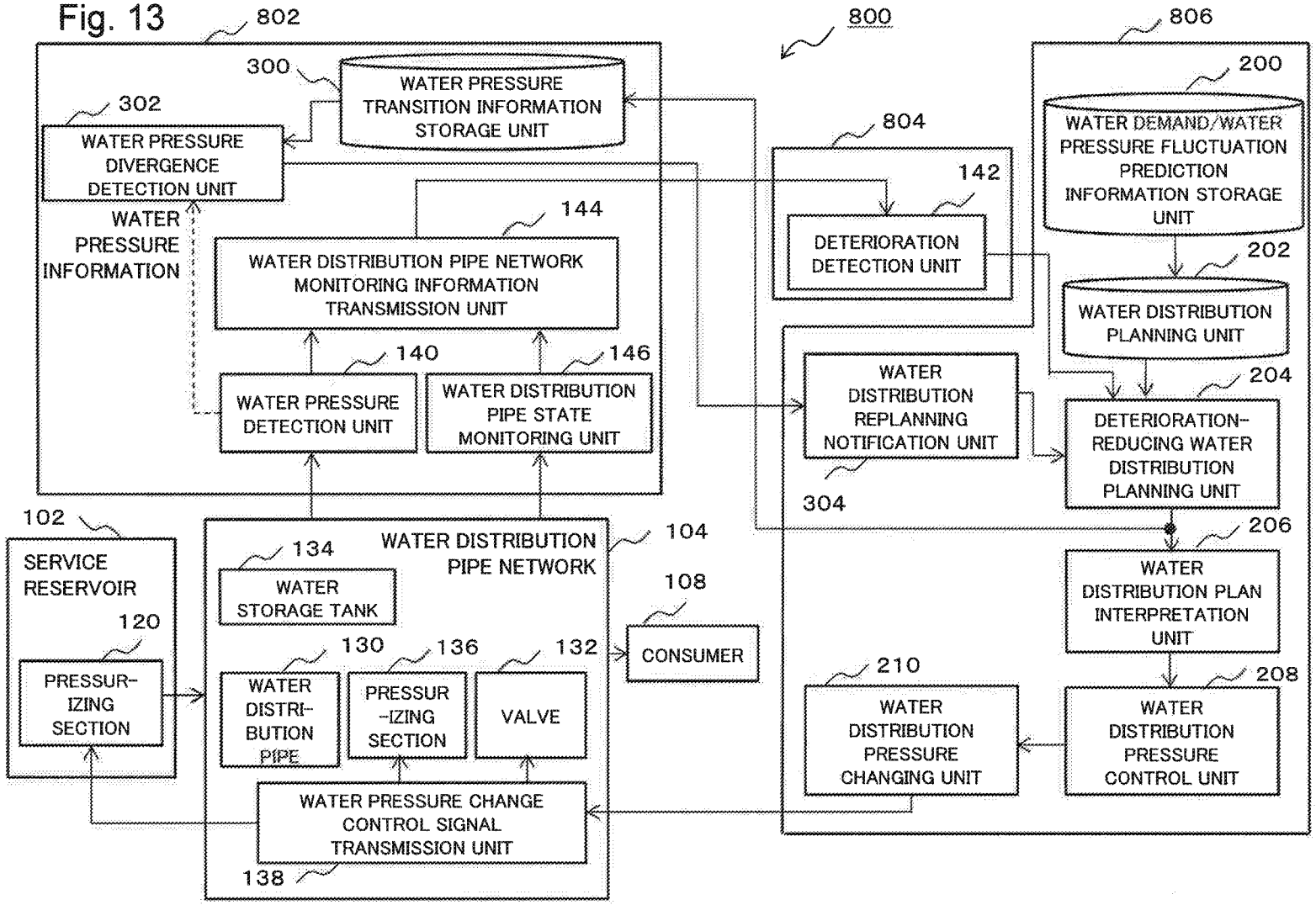
FIG. 13 is a block diagram showing an example of a configuration of a tap water management system according to a third exemplary embodiment of the present invention.

FIG. 13 is a block diagram showing an example of a configuration of a tap water management system 800 according to a third exemplary embodiment of the present invention. The tap water management system 800 includes the water distribution pipe network 104, a water pressure measurement terminal 802, a pipe vibration measurement terminal 804, and a water distribution plan calculator 806.

The water pressure divergence detection unit 302 belonging to the water pressure measurement terminal 802 detects the water pressure divergence by using a calculation resource of the water pressure measurement terminal 802 and instructs the deterioration-reducing water distribution planning unit 204 belonging to the water distribution plan calculator 806 to recreate a water distribution plan via the network when the divergence between the water pressures occurs.

As described above, the tap water management system 800 according to the third exemplary embodiment has advantages in which the water supply operation can be performed at low cost in addition to the advantage of the first and second exemplary embodiments. This is because it is not necessary to transmit information of the water pressure at all times in the third exemplary embodiment and whereby, an electric power consumed by transferring the network data can be reduced, a maintenance interval of the terminal can be extended, and the battery exchange interval or the battery replacement interval can be extended.

Figure 14:
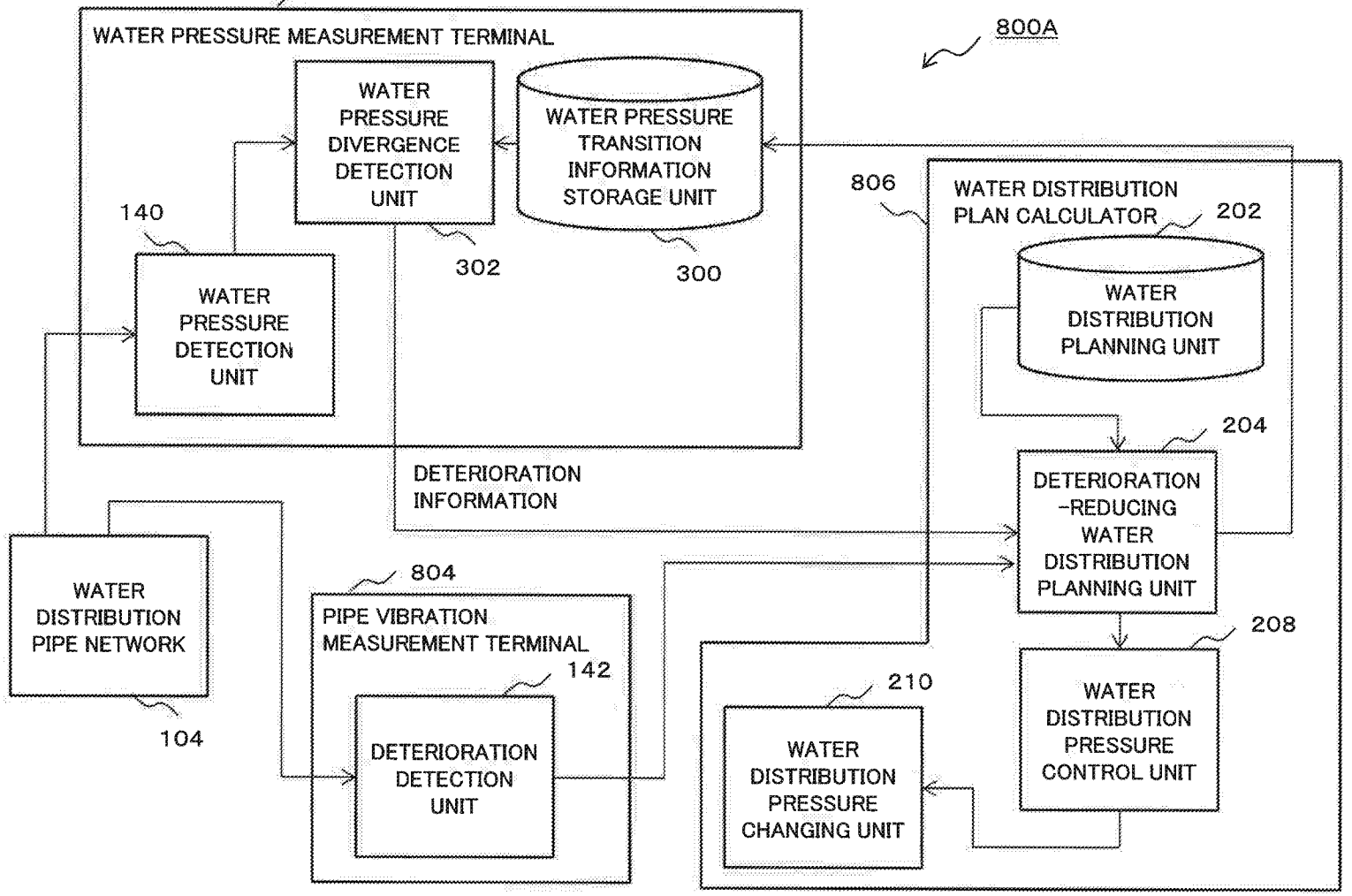
FIG. 14 is a block diagram showing an example of a configuration of a tap water management system as a modification example of a third exemplary embodiment.

FIG. 14 is a block diagram showing an example of configuration of a tap water management system 800A as a modification example of the third exemplary embodiment. The tap water management system 800A includes only the component essential to this exemplary embodiment among all the components included in the tap water management system 800 shown in FIG. 13. These components are the same as those of the tap water management system 800. Therefore, the explanation of these components will be omitted. The tap water management system 800A has an effect similar to that of the third exemplary embodiment mentioned above.

Further, each of the tap water management systems and the tap water management devices according to the first to third exemplary embodiments described above can be widely applied to a tap water management system, a pipeline for oil, a gasoline supply system for vehicle and airplane, a cooling water circulation system, or the like.

Further, a program for realizing all or a part of a function of each exemplary embodiment described above is recorded in a computer-readable recording medium. The program recorded in this recording medium is read by a computer system and executed.

As an example of the "computer system", for example, a CPU (Central Processing Unit) can be used.

The "computer-readable recording medium" is for example, a non-temporary storage device. As an example of the non-temporary storage device, for example, a portable medium such as a magnet-optical disk, a ROM (Read Only Memory), a nonvolatile semiconductor memory, or the like and a hard disk mounted in a computer system can be used. Further, the "computer-readable recording medium" may be a temporary storage device. As an example of the temporary storage device, for example, a communication wire used when a program is transmitted through a network such as internet or the like or a communication line such as a telephone line or the like and a volatile memory in a computer system can be used.

Further, the above-mentioned program may realize a part of the function mentioned above. Additionally, the above-mentioned program may be realized by the combination with the program recorded in the computer system.

The invention of the present application has been described above with reference to the exemplary embodiment. However, the technical scope of the present invention is not limited to the description of the above mentioned exemplary embodiment. Various changes in the configuration or details of the invention of the present application that can be understood by those skilled in the art can be made without departing from the scope of the invention of the present application. The exemplary embodiments to which various changes and modifications are applied are also included in the technical scope of the present invention. A numerical value, a name of the component, or the like used in each exemplary embodiment described above is shown as an example. Therefore, it can be appropriately changed.

A part of or all of the above-mentioned exemplary embodiment can be described as the following supplementary note.

(Supplementary Note 1)

A tap water management system characterized by comprising a water distribution pipe network including a water distribution pipe for carrying clean water from a water distribution site to a consumer, water pressure detection means for detecting a water pressure in at least one location in the water distribution pipe and transmitting a detection result as water pressure information, deterioration detection means for detecting deterioration of the water distribution pipe in at least one location and transmitting a detection result as deterioration information, water distribution plan means for determining a water distribution plan that is a plan of a water distribution pressure based on past information of water demand, deterioration-reducing water distribution plan means for determining a deterioration-reducing water distribution plan according to a degree of deterioration based on the water distribution plan, the water pressure information, and the deterioration information, water distribution pressure change means for changing the water distribution pressure in the water distribution pipe, and water distribution pressure control means for controlling the water distribution pressure change means based on the deterioration-reducing water distribution plan.

(Supplementary Note 2)

The tap water management system described in Supplementary note 1 characterized in that the deterioration-reducing water distribution plan means further comprise water pressure divergence detection means for further outputting water pressure transition information indicating a future water pressure fluctuation based on the water distribution plan, detecting divergence between a current water pressure and a planned water pressure based on information of the current water pressure in the water distribution pipe and the water pressure transition information, and outputting a detection result as water pressure divergence detection information and water distribution re-planning notification means for instructing the deterioration-reducing water distribution plan means to recreate a water distribution plan based on the water pressure divergence detection information.

(Supplementary Note 3)

A tap water management system characterized in that the tap water management system comprises a water distribution pipe network including a water distribution pipe for carrying clean water from a service reservoir to a consumer, a water pressure measurement terminal, a pipe vibration measurement terminal, and a water distribution plan calculator, wherein the water pressure measurement terminal at least include water pressure detection means for detecting the water pressure in at least one location in the water distribution pipe and transmitting a detection result as water pressure information, water pressure transition information storage means for storing the water pressure transition information transmitted from the water distribution plan calculator, and water pressure divergence detection means for comparing the water pressure information with the water pressure transition information, detecting divergence between a current water pressure and a planned water pressure, and outputting a detection result as water pressure divergence detection information, the pipe vibration measurement terminal includes deterioration detection means for detecting deterioration of the water distribution pipe in at least one location and transmitting a detection result as deterioration information and the water distribution plan calculator includes water distribution plan means for determining a water distribution plan that is a plan of a water distribution pressure based on past information of water demand, deterioration-reducing water distribution plan means for determining a deterioration-reducing water distribution plan according to a degree of deterioration based on the water distribution plan, the water pressure information, and the deterioration information, water distribution pressure change means for changing the water distribution pressure in the water distribution pipe, and water distribution pressure control means for controlling the water distribution pressure change means based on the deterioration-reducing water distribution plan.

(Supplementary Note 4)

The tap water management system described in Supplementary note 3 characterized in that the water distribution plan calculator further comprises water distribution re-planning notification means for instructing the deterioration-reducing water distribution plan means to recreate a water distribution plan based on the water pressure divergence detection information.

(Supplementary Note 5)

The tap water management system described in any one of Supplementary note 1 to Supplementary note 4 characterized in that the deterioration-reducing water distribution plan is a plan by which an opening-closing speed of a valve directly or indirectly connected to the water distribution pipe is reduced when a deterioration degree of the water distribution pipe meets predetermined deterioration determination criteria.

(Supplementary Note 6)

The tap water management system described in any one of Supplementary note 1 to Supplementary note 4 characterized in that the deterioration-reducing water distribution plan is a plan by which the water pressure in the water distribution pipe is reduced by changing a water distribution route by a valve opening and closing control when a deterioration degree of the water distribution pipe meets predetermined deterioration determination criteria.

(Supplementary Note 7)

The tap water management system described in any one of Supplementary note 1 to Supplementary note 4 characterized in that the deterioration-reducing water distribution plan is a plan by which a margin for an unnecessary use of water is made small so that the water pressure in the water distribution pipe is equal to or greater than a specified water pressure at a customer's premises and smaller than the previously planned water pressure when a deterioration degree of the water distribution pipe meets predetermined deterioration determination criteria.

(Supplementary Note 8)

The tap water management system described in any one of Supplementary note 1 to Supplementary note 4 characterized in that the deterioration-reducing water distribution plan is a plan by which a valve is controlled or application of pressure is controlled so as not to use the water distribution pipe and at the same time, information for promoting the exchange of the water distribution pipe is transmitted to a worker for maintaining the water distribution pipe network when a deterioration degree of the water distribution pipe meets predetermined deterioration determination criteria.

(Supplementary Note 9)

The tap water management system described in any one of Supplementary note 1 to Supplementary note 8 characterized in that the deterioration detection means analyze one or more changes among a change in feature for each vibration frequency, a change in resonance frequency, and a change in attenuation curve by using the vibration sensor and thereby, quantify a change in physical quantity that reflects the deterioration of the water distribution pipe such as scale deposition, slime attachment, crack or water leakage, a thickness loss, or the like.

(Supplementary Note 10)

The tap water management system described in any one of Supplementary note 1 to Supplementary note 8 characterized in that the deterioration detection means use an acoustic vibration sensor and a temperature sensor, analyze a change in sound velocity, and thereby, quantify the change in physical quantity that reflects the deterioration of the water distribution pipe.

(Supplementary Note 11)

The tap water management system described in any one of Supplementary note 1 to Supplementary note 8 characterized in that the deterioration detection means use an infrared sensor and quantify at least one change among changes such as occurrence of rust on the surface side of the water distribution pipe buried in the ground, occurrence of crack, and occurrence of vibration.

(Supplementary Note 12)

The tap water management system described in any one of Supplementary note 1 to Supplementary note 8 characterized in that the deterioration detection means use an ultrasonic sensor and quantify a size or a depth of a crack of the water distribution pipe.

(Supplementary Note 13)

The tap water management system described in any one of Supplementary note 1 to Supplementary note 8 characterized in that the deterioration detection means detect at least one of rust in water inside the water distribution pipe, slime, contamination, microorganism, and the residual chloride concentration by using a water quality sensor and quantify the deterioration of the water distribution pipe.

(Supplementary Note 14)

The tap water management system described in any one of Supplementary note 9 to Supplementary note 13 characterized in that the deterioration detection means quantify the deterioration of the water distribution pipe by using two or more sensors among a plurality of the above-mentioned sensors.

(Supplementary Note 15)

A tap water management device which controls a water distribution pressure in a water distribution pipe for carrying clean water from a service reservoir to a consumer characterized by comprising water distribution plan means for determining a water distribution plan that is a plan of a water distribution pressure based on past information of water demand, deterioration-reducing water distribution plan means for determining a deterioration-reducing water distribution plan according to a degree of deterioration based on the water distribution plan, water pressure information of the water distribution pipe, and deterioration information of the water distribution pipe, and water distribution pressure control means for controlling the water distribution pressure based on the deterioration-reducing water distribution plan.

(Supplementary Note 16)

A tap water management method for controlling a water distribution pressure in a water distribution pipe for carrying clean water from a service reservoir to a consumer comprising:

determining a water distribution plan that is a plan of the delivery water pressure based on past information of water demand, determining a deterioration-reducing water distribution plan according to a degree of deterioration based on the water distribution plan, water pressure information of the water distribution pipe, and deterioration information of the water distribution pipe, and controlling the water distribution pressure based on the deterioration-reducing water distribution plan.

(Supplementary Note 17)

A tap water management program which causes a computer of a tap water management device which controls a water distribution pressure in a water distribution pipe for carrying clean water from a service reservoir to a consumer to perform a water distribution plan function to determine a water distribution plan that is a plan of the water distribution pressure based on past information of water demand;

a deterioration-reducing water distribution plan function to determine a deterioration-reducing water distribution plan according to a degree of deterioration based on the water distribution plan, water pressure information of the water distribution pipe, and deterioration information of the water distribution pipe, and a water distribution pressure control function to control the water distribution pressure based on the deterioration-reducing water distribution plan.

This application claims priority from Japanese Patent Application No. 2014-219807 filed on Oct. 29, 2014, the disclosure of which is hereby incorporated by reference in its entirety.

REFERENCE SIGNS LIST

100 and 100A tap water management system
102 service reservoir
104 water distribution pipe network
106 water distribution pipe network monitoring device
108 consumer
110 water supply monitoring operation center
120 pressurizing section
130 water distribution pipe
132 valve
134 water storage tank
136 pressurizing section
138 water pressure change control signal transmission unit
140 water pressure detection unit
142, 142A, and 142B deterioration detection unit

144 water distribution pipe network monitoring information transmission unit
146 water distribution pipe state monitoring unit
200 water demand/water pressure fluctuation prediction information storage unit
202 water distribution planning unit
204 deterioration-reducing water distribution planning unit
206 water distribution plan interpretation unit
208 water distribution pressure control unit
210 water distribution pressure changing unit
400 sensor
402 processor
404 primary storage unit
406 secondary storage unit
408 communication unit
410 peripheral controller
420 antenna
422 battery
450 first processor
452 second processor
460 first primary storage unit
462 second primary storage unit
500 water distribution pipe network
502 first water distribution pipe network
504 second water distribution pipe network
506 third water distribution pipe network
600 first water distribution pipe
602 consumer
608 first service reservoir
610 second service reservoir
612 first valve
614 second valve
616 second water distribution pipe
700 tap water management device
750 and 750A tap water management system
800 and 800A tap water management system
802 water pressure measurement terminal
804 pipe vibration measurement terminal
806 water distribution plan calculator

What is claimed is:

1. A tap water management system comprising:

water pressure detection unit configured to detect a water pressure in at least one location in a water distribution pipe for carrying clean water from a water distribution site to a consumer and transmit a detection result as water pressure information;

deterioration detection unit configured to detect deterioration of the water distribution pipe in at least one location and transmit a detection result as deterioration information;

water distribution plan unit configured to determine a water distribution plan that is a plan of a water distribution pressure based on past information of water demand;

deterioration-reducing water distribution plan unit configured to determine a deterioration-reducing water distribution plan according to a degree of deterioration based on the water distribution plan, the water pressure information, and the deterioration information;

water distribution pressure change unit configured to change the water distribution pressure in the water distribution pipe; and water distribution pressure control unit configured to control the water distribution pressure change means based on the deterioration-reducing water distribution plan, wherein the deterioration-reducing water distribution plan unit outputs water pressure transition information indicating a future water pressure fluctuation based on the water distribution plan, and the tap water management system further comprises:

water pressure divergence detection unit configured to detect divergence between a current water pressure and a planned water pressure based on information of the current water pressure in the water distribution pipe and the water pressure transition information, and output a detection result as water pressure divergence detection information; and water distribution re-planning notification unit configured to instruct the deterioration-reducing water distribution plan unit to recreate a water distribution plan based on the water pressure divergence detection information.

2. A tap water management system comprising:

a water pressure measurement terminal;

a pipe vibration measurement terminal; and a water distribution plan calculator, wherein the water pressure measurement terminal at least includes:

water pressure detection unit configured to detect the water pressure in at least one location in a water distribution pipe for carrying clean water from a service reservoir to a consumer and transmit a detection result as water pressure information;

water pressure transition information storage unit configured to storage the water pressure transition information transmitted from the water distribution plan calculator; and water pressure divergence detection unit configured to compare the water pressure information with the water pressure transition information, detect divergence between a current water pressure and a planned water pressure, and output a detection result as water pressure divergence detection information, the pipe vibration measurement terminal includes deterioration detection unit configured to detect deterioration of the water distribution pipe in at least one location and transmit a detection result as deterioration information and the water distribution plan calculator includes:

water distribution plan unit configured to determine a water distribution plan that is a plan of a water distribution pressure based on past information of water demand;

deterioration-reducing water distribution plan unit configured to determine a deterioration-reducing water distribution plan according to a degree of deterioration based on the water distribution plan, the water pressure information, and the deterioration information;

water distribution pressure change unit configured to change the water distribution pressure in the water distribution pipe; and water distribution pressure control unit configured to control the water distribution pressure change means based on the deterioration-reducing water distribution plan.

3. The tap water management system according to claim 1, wherein the deterioration-reducing water distribution plan is a plan by which an opening and closing speed of a valve directly or indirectly connected to the water distribution pipe is reduced when a deterioration degree of the water distribution pipe meets predetermined deterioration determination criteria.

4. The tap water management system according to claim 1, wherein the deterioration-reducing water distribution plan is a plan by which the water pressure in the water distribution pipe is reduced by changing a water distribution route by a valve opening and closing control when a deterioration degree of the water distribution pipe meets predetermined deterioration determination criteria.

5. The tap water management system according to claim 1, wherein the deterioration-reducing water distribution plan is a plan by which a margin for an unnecessary use of water is decreased so that the water pressure in the water distribution pipe is equal to or greater than a specified water pressure at a customer's premises and less than the previously planned water pressure when a deterioration degree of the water distribution pipe meets predetermined deterioration determination criteria.

6. The tap water management system according to claim 1, wherein the deterioration-reducing water distribution plan is a plan by which a valve is controlled or application of pressure is controlled so as not to use the water distribution pipe and at the same time, information for promoting the exchange of the water distribution pipe is transmitted to a worker for maintaining the water distribution pipe network when a deterioration degree of the water distribution pipe meets predetermined deterioration determination criteria.

7. A tap water management device comprising:

water distribution plan unit configured to determine a water distribution plan that is a plan of a water distribution pressure in a water distribution pipe for carrying clean water from a service reservoir to a consumer based on past information of water demand;

deterioration-reducing water distribution plan unit configured to determine a deterioration-reducing water distribution plan according to a degree of deterioration based on the water distribution plan, water pressure information of the water distribution pipe, and deterioration information of the water distribution pipe; and water distribution pressure control unit configured to control the water distribution pressure based on the deterioration-reducing water distribution plan, wherein the deterioration-reducing water distribution plan unit outputs water pressure transition information indicating a future water pressure fluctuation based on the water distribution plan, and the tap water management system further comprises:

water pressure divergence detection unit configured to detect divergence between a current water pressure and a planned water pressure based on information of the current water pressure in the water distribution pipe and the water pressure transition information, and output a detection result as water pressure divergence detection information; and water distribution re-planning notification unit configured to instruct the deterioration-reducing water distribution plan unit to recreate a water distribution plan based on the water pressure divergence detection information.

8. The tap water management system according to claim 2, wherein the water distribution plan calculator further comprises water distribution re-planning notification unit configured to instruct the deterioration-reducing water distribution plan unit to recreate a water distribution plan based on the water pressure divergence detection information.

9. The tap water management system according to claim 1, wherein the deterioration detection unit analyzes one or more changes among a change in feature for each vibration frequency, a change in resonance frequency, and a change in attenuation curve by using the vibration sensor and thereby, quantifies a change in physical quantity that reflects the deterioration of the water distribution pipe such as scale deposition, slime attachment, crack or water leakage, a thickness loss, or the like.

10. The tap water management system according to claim 1, wherein the deterioration detection unit uses an acoustic vibration sensor and a temperature sensor, analyzes a change in sound velocity, and thereby, quantify the change in physical quantity that reflects the deterioration of the water distribution pipe.

11. The tap water management system according to claim 1, wherein the deterioration detection unit uses an infrared sensor and quantifies at least one change among changes such as occurrence of rust on the surface side of the water distribution pipe buried in the ground, occurrence of crack, and occurrence of vibration.

12. The tap water management system according to claim 1, wherein the deterioration detection unit uses an ultrasonic sensor and quantifies a size or a depth of a crack of the water distribution pipe.

13. The tap water management system according to claim 1, wherein the deterioration detection unit detects at least one of rust in water inside the water distribution pipe, slime, contamination, microorganism, and the residual chloride concentration by using a water quality sensor and quantifies the deterioration of the water distribution pipe.

14. The tap water management system according to claim 9, wherein the deterioration detection unit quantifies the deterioration of the water distribution pipe by using two or more sensors among a plurality of the sensors.

* * * * *